US007463229B2

(12) United States Patent
Morita

(10) Patent No.: US 7,463,229 B2
(45) **Date of Patent: *Dec. 9, 2008**

(54) DISPLAY DRIVER, DISPLAY DEVICE, AND DRIVE METHOD

(75) Inventor: Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 720 days.

This patent is subject to a terminal disclaimer.

(21) Appl. No.: 10/891,298

(22) Filed: Jul. 15, 2004

(65) Prior Publication Data

US 2005/0078078 A1 Apr. 14, 2005

(30) Foreign Application Priority Data

Jul. 18, 2003 (JP) ..... 2003-277028

(51) Int. Cl.
*G09G 3/36* (2006.01)

(52) U.S. Cl. ..... 345/87; 345/211

(58) Field of Classification Search ..... 345/87–100, 345/74.1–83, 211–213
See application file for complete search history.

(56) References Cited

U.S. PATENT DOCUMENTS

| | | | | |
|---|---|---|---|---|
| 5,781,171 | A * | 7/1998 | Kihara et al. | 345/93 |
| 6,181,314 | B1 * | 1/2001 | Nakajima et al. | 345/100 |
| 6,492,970 | B1 * | 12/2002 | Furuhashi et al. | 345/94 |
| 6,509,895 | B2 * | 1/2003 | Yanagi et al. | 345/211 |
| 2002/0105492 | A1 * | 8/2002 | Kosaka | 345/89 |
| 2003/0151577 | A1 * | 8/2003 | Morita | 345/89 |
| 2005/0057470 | A1 * | 3/2005 | Tobita | 345/89 |
| 2005/0088387 | A1 * | 4/2005 | Yokoyama et al. | 345/87 |

FOREIGN PATENT DOCUMENTS

| | | |
|---|---|---|
| JP | A 07-013528 | 1/1995 |
| JP | A 08-211849 | 8/1996 |
| JP | A 08-221041 | 8/1996 |
| JP | A 08-286639 | 11/1996 |
| JP | 10-11032 | 1/1998 |
| JP | A 10-143113 | 5/1998 |
| JP | A 2003-058118 | 2/2003 |

OTHER PUBLICATIONS

U.S. Appl. No. 10/891,146, filed Jul. 15, 2004, Akira Morita.
U.S. Appl. No. 10/891,195, filed Jul. 15, 2004, Akira Morita.

* cited by examiner

*Primary Examiner*—Ricardo L Osorio

(57) ABSTRACT

A display driver includes: a data line driver circuit which drives an output line connected with a data line based on a drive voltage corresponding to display data; a first switching element connected between a first power supply line and the output line; a second switching element connected between a second power supply line and the output line; and a switch control circuit which controls the first and second switching elements. In a first period, the first switching element is set to an on-state, and the second switching element is set to an off-state. In a second period after the first period, the first switching element is set to an off-state, and the second switching element is set to an on-state. After the second period, the first and second switching elements are set to an off-state, and the data line driver circuit drives the output line.

20 Claims, 19 Drawing Sheets

DISPLAY DRIVER, DISPLAY DEVICE, AND DRIVE METHOD

Japanese Patent Application No. 2003-277028, filed on Jul. 18, 2003 is hereby incorporated by reference in its entirety.

BACKGROUND OF THE INVENTION

The present invention relates to a display driver, a display device, and a drive method.

A precharge technology which increases the liquid crystal drive speed of an active matrix type liquid crystal display device (display device in a broad sense) is known. In this precharge technology, a data line is precharged to a predetermined potential before driving the data line based on display data to reduce the amount of charging/discharging of the data line accompanying supply of a drive voltage based on the display data.

This precharge technology is disclosed in Japanese Patent Application Laid-open No. 10-11032, for example. In Japanese Patent Application Laid-open No. 10-11032, different direct-current potentials are provided in advance, and a switch is provided between the direct-current potentials and the data line. This precharge technology controls connection between the direct-current potential provided in advance and the data line by controlling the switch corresponding to the polarity of liquid crystal reversal drive. According to this precharge technology, the amount of charging/discharging of the data line accompanying drive is small even if the precharge cycle is reduced, whereby an increase in power consumption can be prevented and an accurate voltage can be supplied to the data line.

BRIEF SUMMARY OF THE INVENTION

According to one aspect of the present invention, there is provided a display driver which drives a data line of a display panel, the display driver comprising:

a data line driver circuit which drives an output line connected with the data line based on a drive voltage corresponding to display data;

a first switching element connected between a first power supply line to which a first power supply voltage is supplied and the output line;

a second switching element connected between a second power supply line to which a second power supply voltage is supplied and the output line; and a switch control circuit which controls the first and second switching elements, wherein the switch control circuit electrically connects the output line with the first power supply line in a first period by setting the first switching element to an on-state and setting the second switching element to an off-state, electrically connects the output line with the second power supply line in a second period after the first period by setting the first switching element to an off-state and setting the second switching element to an on-state, and sets the first and second switching elements to an off-state after the second period, and wherein the data line driver circuit drives the output line after the second period.

DETAILED DESCRIPTION OF THE EMBODIMENT

Figure 1:
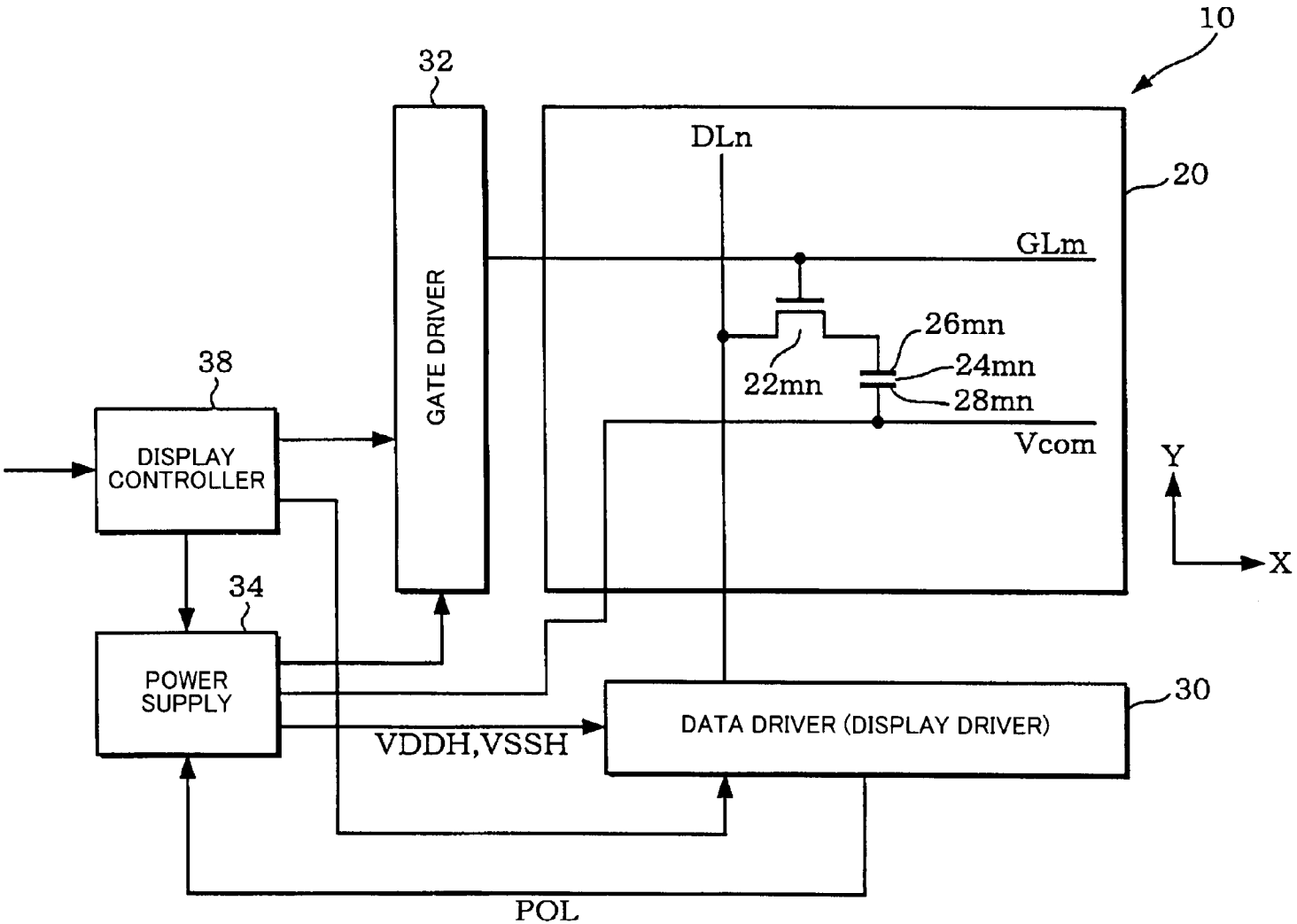
FIG. 1 is a block diagram showing an outline of a configuration of a display device including a display driver in an embodiment of the present invention.

Embodiments of the present invention are described below. Note that the embodiments described hereunder do not in any way limit the scope of the invention defined by the claims laid out herein. Note also that all of the elements described below should not be taken as essential requirements for the present invention.

A switch connected between a direct-current potential and a data line may be formed by a metal-oxide semiconductor (MOS) transistor in order to perform the above-described precharge technology. However, the charge/discharge time of the data line is increased as the voltage applied between the source and drain of the MOS transistor is decreased. Therefore, the precharge technology disclosed in Japanese Patent Application Laid-open No. 10-11032 may not cause electric charges stored in the data line to be completely discharged, since the direct-current potential provided in advance and the data line are connected corresponding to the polarity of the liquid crystal reversal drive. In this case, the data line may not be set at a desired potential, thereby causing the display quality to deteriorate.

Japanese Patent Application Laid-open No. 10-11032 discloses that the charge/discharge speed of the data line is increased by increasing the difference between the potential of the data line and the precharge potential. However, the circuit scale is increased by additionally providing the precharge potential in addition to an amount of potentials necessary for driving the liquid crystal. Furthermore, power consumption is significantly increased by merely connecting the data line with the precharge potential.

According to the following embodiments, a display driver, a display device, and a drive method which can drive the data line by using the precharge technology while preventing an increase in power consumption and deterioration of the display quality can be provided.

According to one embodiment of the present invention, there is provided a display driver which drives a data line of a display panel, the display driver comprising:

a data line driver circuit which drives an output line connected with the data line based on a drive voltage corresponding to display data;

a first switching element connected between a first power supply line to which a first power supply voltage is supplied and the output line;

a second switching element connected between a second power supply line to which a second power supply voltage is supplied and the output line; and a switch control circuit which controls the first and second switching elements, wherein the switch control circuit electrically connects the output line with the first power supply line in a first period by setting the first switching element to an on-state and setting the second switching element to an off-state, electrically connects the output line with the second power supply line in a second period after the first period by setting the first switching element to an off-state and setting the second switching element to an on-state, and sets the first and second switching elements to an off-state after the second period, and wherein the data line driver circuit drives the output line after the second period.

The data line is precharged in each of the first and second periods before the data line is driven by the data line driver circuit. This reduces the charge/discharge time of the data line by using the precharge technology, whereby deterioration of the display quality can be prevented.

Moreover, since the configuration in which the data line is precharged in two stages is employed, the amount of electric charges flowing from the data line into the second power supply line during charging/discharging of the data line can be minimized, for example. In particular, in the case where the second power supply voltage of the second power supply line is a system ground power supply voltage, since positive charges flow toward the system ground side, power consumption is increased. A precharge method in which the data line is merely connected with the potential provided in advance causes electric charges to flow into the second power supply line during charging/discharging of the data line, whereby power consumption is increased. However, according to the embodiment of the present invention, since the amount of electric charges flowing into the second power supply line can be minimized by precharging the data line to the first power supply voltage, power consumption can be reduced.

In the display driver, an absolute value of a difference between a voltage of the data line and the first power supply voltage may be smaller than an absolute value of a difference between the voltage of the data line and the second power supply voltage, when the first period starts.

In the case of driving the data line at a low potential, the data line is precharged to a higher potential and is then precharged to a lower potential. Therefore, since the period in which positive charges flow toward the lower potential can be reduced, power consumption can be reduced by reutilizing electric charges due to precharging to a higher potential. Moreover, since the data line is precharged to a lower potential before driving the data line based on the display data, an accurate voltage can be supplied to the data line even if the precharge cycle is reduced, whereby it is possible to deal with an increase in the display size and to prevent deterioration of the display quality.

In the case of driving the data line at a high potential, the data line is precharged to a lower potential and is then precharged to a higher potential. Therefore, since the period in which negative charges flow toward a higher potential can be reduced, power consumption can be reduced by reutilizing electric charges due to precharging to a lower potential. Moreover, since the data line is precharged to a higher potential before driving the data line based on the display data, an accurate voltage can be supplied to the data line even if the precharge cycle is reduced.

In the display driver, the switch control circuit may control the first and second switching elements so that the first period is longer than the second period.

Since the amount of electric charges consumed by charging/discharging of the data line can be reduced, power consumption can be further reduced.

In the display driver, the first power supply voltage may be higher than the second power supply voltage, a first precharge period may be provided before a drive period in which a polarity of the drive voltage is negative with respect to a given reference potential, a second precharge period may be provided before a drive period in which the polarity is positive with respect to the reference potential, and the switch control circuit:

may set the first switching element to an on-state and sets the second switching element to an off-state in a first divisional period in the first precharge period;

may set the first switching element to an off-state and sets the second switching element to an on-state in a second divisional period after the first divisional period;

may set the first switching element to an off-state and sets the second switching element to an on-state in a third divisional period in the second precharge period; and may set the first switching element to an on-state and sets the second switching element to an off-state in a fourth divisional period after the third divisional period.

This makes it possible to reduce power consumption accompanying charging/discharging of the data line by the polarity inversion drive, and to prevent deterioration of the display quality.

In the display driver, the switch control circuit may control the first and second switching elements so that the first divisional period is longer than the second divisional period and the third divisional period is longer than the fourth divisional period.

Since the amount of electric charges consumed by charging/discharging of the data line can be reduced, power consumption can be further reduced.

In the display driver, the switch control circuit may include first to fourth divisional period setting registers, and may control the first and second switching elements based on values set in the first to fourth divisional period setting registers.

Since it is possible to set the first to fourth divisional periods dependent on the display panel as the drive target or the like, a display driver which can maintain an optimal display quality for the drive target with reduced power consumption can be provided.

In the display driver, the first power supply voltage may be a high-potential-side power supply voltage of the data line driver circuit, and the second power supply voltage may be a low-potential-side power supply voltage of the data line driver circuit.

In the display driver, the first power supply voltage may be a maximum value of the drive voltage, and the second power supply voltage may be a minimum value of the drive voltage.

According to another embodiment of the present invention, there is provided a display device comprising:

a display panel which includes a plurality of scan lines, the data line, and a plurality of switching elements, each of the plurality of switching elements being connected with one of the scan lines and the data line; and one of the above described display drivers which drives the data line.

According to a further embodiment of the present invention, there is provided a display device comprising:

a plurality of scan lines;

the data line;

a plurality of switching elements, each of the plurality of switching elements being connected with one of the scan lines and the data line; and one of the above described display drivers which drives the data line.

This enables to provide a display device which can maintain an optimal display quality with reduced power consumption.

According to still another embodiment of the present invention, there is provided a drive method for driving a data line of a display panel, the drive method comprising:

providing a first switching element and a second switching element, the first switching element being connected between a first power supply line to which a first power supply voltage is supplied and the data line, the second switching element being connected between a second power supply line to which a second power supply voltage is supplied and the data line;

electrically connecting the data line with the first power supply line by setting the first switching element to an on-state and setting the second switching element to an off-state;

electrically connecting the data line with the second power supply line by setting the first switching element to an off-state and setting the second switching element to an on-state after electrically connecting the data line with the first power supply line; and setting the first and second switching elements to an off-state after electrically connecting the data line with the second power supply line, and driving the data line based on a drive voltage corresponding to display data.

The data line may include color component data lines connected with a data signal supply line connected with the display driver through a demultiplexer in a display panel formed by using a low-temperature polysilicon process, for example. Therefore, the data lines can be connected with the first or second power supply line by electrically connecting the data signal supply line with all the color component data lines by the demultiplexer before controlling the first and second switching elements.

According to a still further embodiment of the present invention, there is provided a drive method for driving a data line of a display panel, the drive method comprising:

providing a first switching element and a second switching element, the first switching element being connected between a first power supply line to which a first power supply voltage is supplied and the data line, the second switching element being connected between a second power supply line to which a second power supply voltage is supplied and the data line, the second power supply voltage being lower than the first power supply voltage;

in a first precharge period provided before a drive period in which a polarity of a drive voltage corresponding to display data is negative with respect to a given reference potential, setting the first switching element to an on-state and setting the second switching element to an off-state in a first divisional period in the first precharge period, and setting the first switching element to an off-state and setting the second switching element to an on-state in a second divisional period after the first divisional period; and setting the first and second switching elements to an off-state after the first precharge period, and driving the data line based on the drive voltage.

In the drive method, the first divisional period may be longer than the second divisional period.

According to yet another embodiment of the present invention, there is provided a drive method for driving a data line of a display panel, the drive method comprising:

providing a first switching element connected between a first power supply line to which a first power supply voltage is supplied and the data line, and a second switching element connected between a second power supply line to which a second power supply voltage is supplied and the data line, the second power supply voltage being lower than the first power supply voltage;

in a second precharge period provided before a drive period in which a polarity of a drive voltage corresponding to display data is positive with respect to a given reference potential, setting the first switching element to an off-state and setting the second switching element to an on-state in a third divisional period in the second precharge period, and setting the first switching element to an on-state and setting the second switching element to an off-state in a fourth divisional period after the third divisional period; and setting the first and second switching elements to an off-state after the second precharge period, and driving the data line based on the drive voltage.

In the drive method, the third divisional period may be longer than the fourth divisional period.

In the drive method, the first power supply voltage may be a high-potential-side power supply voltage of a data line driver circuit which drives the data line based on the drive voltage, and the second power supply voltage may be a low-potential-side power supply voltage of the data line driver circuit.

In the drive method, the first power supply voltage may be a maximum value of the drive voltage, and the second power supply voltage may be a minimum value of the drive voltage.

The embodiments of the present invention are described below in detail with reference to the drawings.

1. Outline of Display Device

FIG. 1 shows an outline of a configuration of a display device including a display driver in the present embodiment.

A display device 10 (electro-optical device or liquid crystal device in a narrow sense) may include a display panel 20 (liquid crystal panel in a narrow sense).

The display panel 20 is formed on a glass substrate, for example. A plurality of scan lines (gate lines) GL1 to GLM (M is an integer of two or more), arranged in the Y direction and extending in the X direction, and a plurality of data lines (source lines) DL1 to DLN (N is an integer of two or more), arranged in the X direction and extending in the Y direction, are disposed on the glass substrate. A pixel region (pixel) is provided corresponding to the intersecting point of the scan line GLm ($1 \leqq m \leqq M$, m is an integer; hereinafter the same) and the data line DLn ($1 \leqq n \leqq N$, n is an integer; hereinafter the same). A thin-film transistor 22*mn* (hereinafter abbreviated as "TFT") is disposed in the pixel region.

A gate electrode of the TFT 22*mn* is connected with the scan line GLn. A source electrode of the TFT 22*mn* is connected with the data line DLn. A drain electrode of the TFT 22*mn* is connected with the pixel electrode 26*mn*. A liquid crystal is sealed between the pixel electrode 26*mn* and a common electrode 28*mn* which faces the pixel electrode 26*mn*, whereby a liquid crystal capacitor 24*mn* (liquid crystal element in a broad sense) is formed. The transmittance of the pixel changes corresponding to the voltage applied between the pixel electrode 26*mn* and the common electrode 28*mn*. A common electrode voltage Vcom is supplied to the common electrode 28*mn*.

The display device 10 may include a display driver 30 (data driver in a narrow sense). The display driver 30 drives the data lines DL1 to DLN of the display panel 20 based on display data.

The display device 10 may include a gate driver 32. The gate driver 32 scans the scan lines GL1 to GLM of the display panel 20 within one vertical scanning period.

The display device 10 may include a power supply circuit 34. The power supply circuit 34 generates voltages necessary for driving the data lines, and supplies the voltages to the display driver 30. In the present embodiment, the power supply circuit 34 generates power supply voltages VDDH and VSSH necessary for driving the data lines of the display driver 30 and voltages for the logic section of the display driver 30.

The power supply circuit 34 generates voltages necessary for scanning the scan lines, and supplies the voltages to the gate driver 32. In the present embodiment, the power supply circuit 34 generates drive voltages for scanning the scan lines.

The power supply circuit 34 may generate the common electrode voltage Vcom. The power supply circuit 34 outputs the common electrode voltage Vcom, which is repeatedly set at a high-potential-side voltage VcomH and a low-potential-side voltage VcomL in synchronization with timing of a polarity inversion signal POL generated by the display driver 30, to the common electrode of the display panel 20.

The display device 10 may include a display controller 38. The display controller 38 controls the display driver 30, the gate driver 32, and the power supply circuit 34 according to the contents set by a host such as a central processing unit (hereinafter abbreviated as "CPU") (not shown). The display controller 38 provides an operation mode setting and a vertical synchronization signal or a horizontal synchronization signal generated therein to the display driver 30 and the gate driver 32, for example.

In FIG. 1, the display device 10 includes the power supply circuit 34 or the display controller 38. However, at least one of the power supply circuit 34 and the display controller 38 may be provided outside the display device 10. The display device 10 may include the host.

The display driver 30 may include at least one of the gate driver 32 and the power supply circuit 34.

Figure 2:
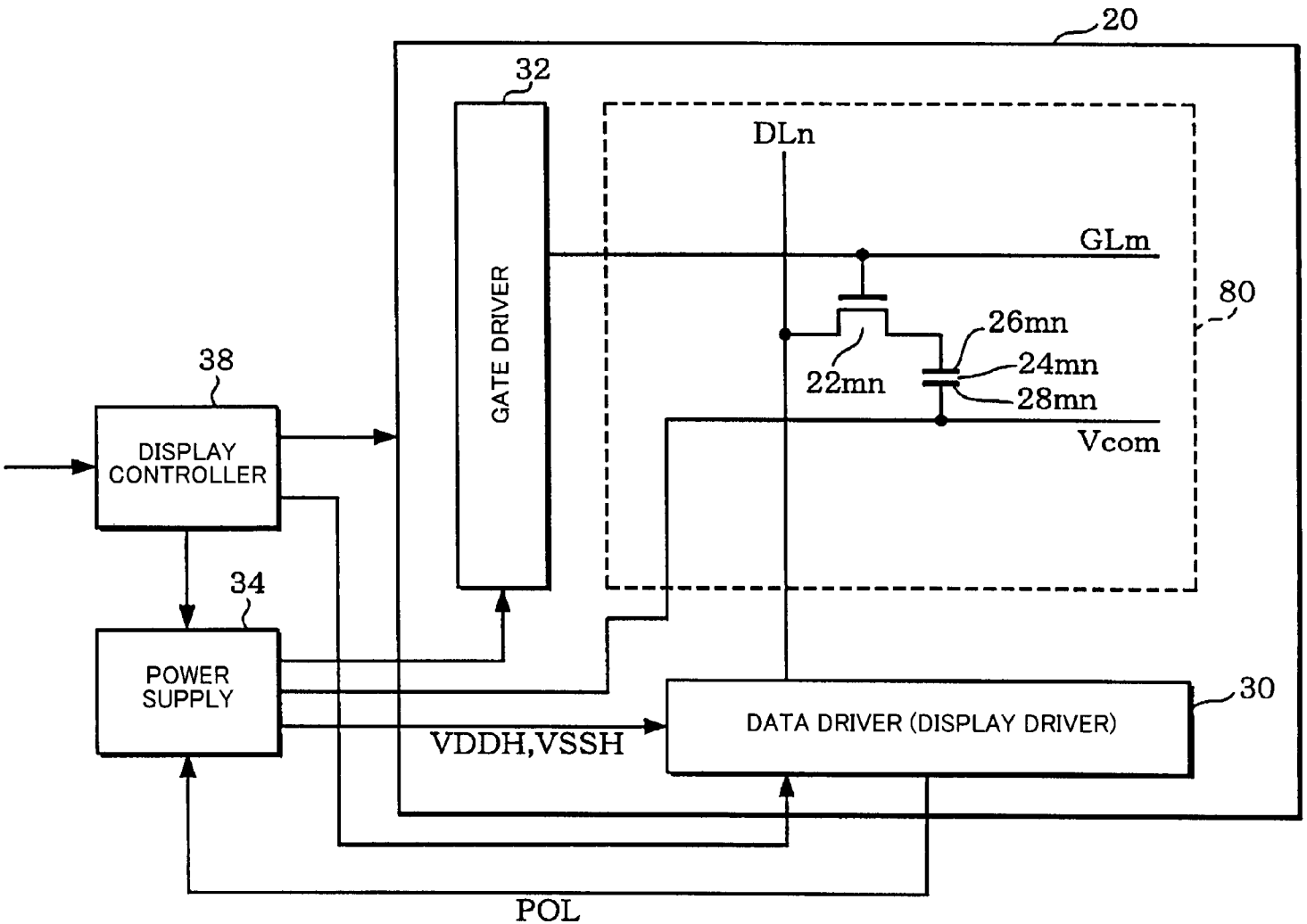
FIG. 2 is a block diagram showing an outline of another configuration example of a display device in an embodiment of the present invention.

At least one of the display driver 30, the gate driver 32, the display controller 38, and the power supply circuit 34 may be formed on the display panel 20, for example. In FIG. 2, the display driver 30 and the gate driver 32 are formed on the display panel 20. As described above, the display panel 20 may be configured to include a plurality of data lines, a plurality of scan lines, a plurality of switching elements, each of the switching elements being connected with one of the scan lines and one of the data lines, and a display driver which drives the data lines. A plurality of pixels are formed in a pixel formation region 80 of the display panel 20.

2. Outline of Display Driver

Figure 3:
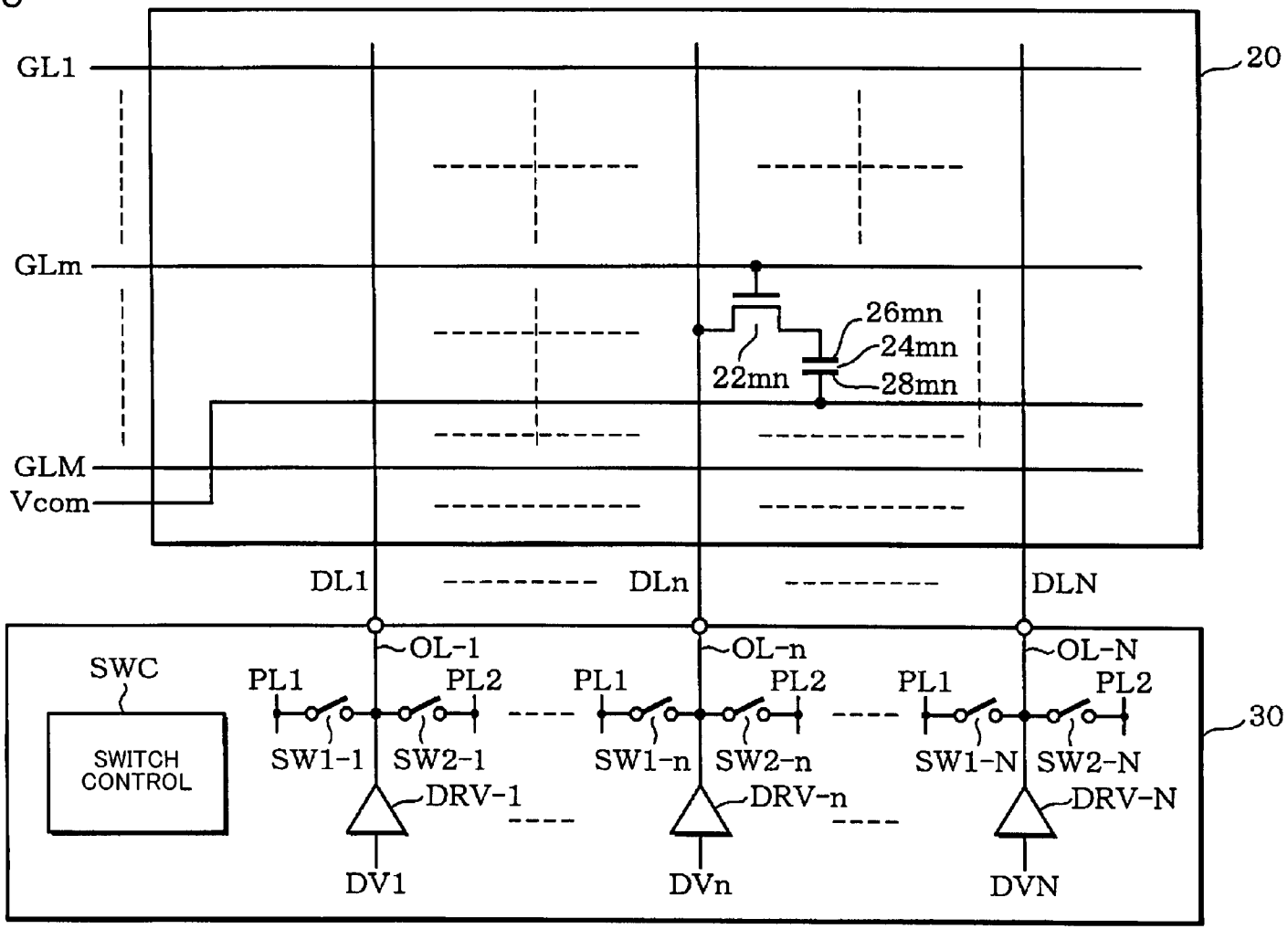
FIG. 3 is a configuration diagram of an essential portion of a display driver in an embodiment of the present invention.

FIG. 3 shows an essential portion of a configuration of the display driver in the present embodiment. In FIG. 3, sections the same as the sections shown in FIG. 1 or 2 are denoted by the same symbols. Description of these sections is appropriately omitted.

The display driver 30 drives the data lines DL1, to DLN based on the display data. The display data corresponds to the data line.

The display driver 30 includes data line driver circuits DRV-1 to DRV-N, first switching elements SW1-1 to SW1-N, second switching elements SW2-1 to SW2-N, and a switch control circuit SWC. The first and second switching elements SW1-1 to SW1-N and SW2-1 to SW2-N are formed by MOS transistors.

The output of the data line driver circuit DRV-n ($1 \leqq n \leqq N$, n is an integer) is connected with an output line OL-n. The output line OL-n is connected with the data line DLn of the display panel 20. The data line driver circuit DRV-n outputs a drive voltage DVn corresponding to the display data to the output line OL-n.

The first switching element SW1-*n* is connected between a first power supply line PL1 to which a first power supply voltage PV1 is supplied and the output line OL-n. The first switching element SW1-*n* is ON-OFF controlled by a first switch control signal SC1. The first power supply line PL1 is electrically connected with the output line OL-n when the first switching element SW1-*n* is in an on-state. The first power supply line PL1 is electrically disconnected from the output line OL-n when the first switching element SW1-*n* is in an off-state.

The second switching element SW2-*n* is connected between a second power supply line PL2 to which a second power supply voltage PV2 is supplied and the output line OL-n. The second switching element SW2-*n* is ON-OFF controlled by a second switch control signal SC2. The second power supply line PL2 is electrically connected with the output line OL-n when the second switching element SW2-*n* is in an on-state. The second power supply line PL2 is electrically disconnected from the output line OL-n when the second switching element SW2-*n* is in an off-state.

The switch control circuit SWC controls the first and second switching elements SW1-1 to SW1-N and SW2-1 to SW2-N. In more detail, the switch control circuit SWC generates the first and second switch control signals SC1 and SC2. The switch control circuit SWC controls the first switching elements SW1-1 to SW1-N by using the first switch control signal SC1, and controls the second switching elements SW2-1 to SW2-N by using the second switch control signal SC2.

Figure 4:
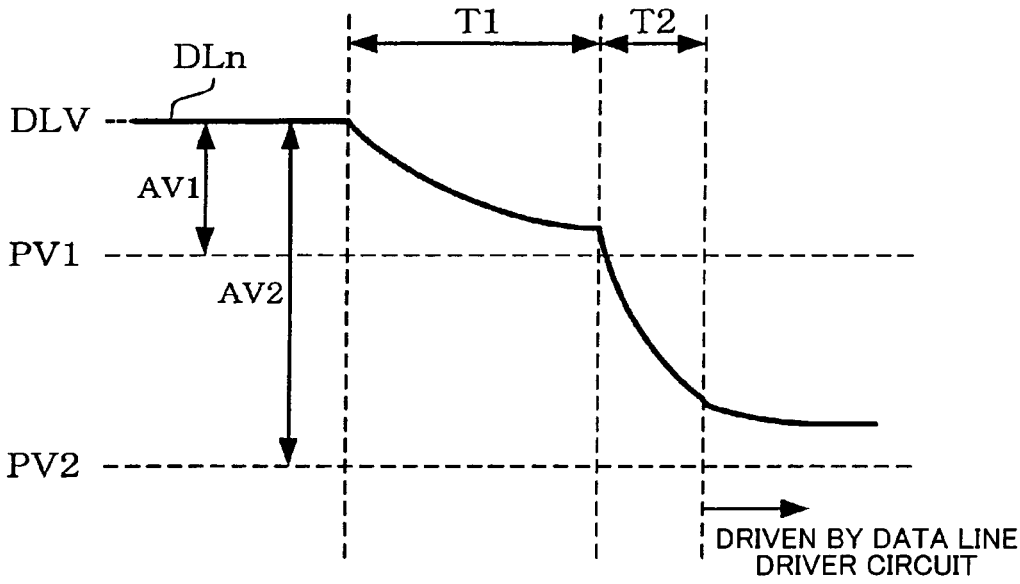
FIG. 4 is a schematic diagram of an example of a change in potential of a data line driven by a display driver in an embodiment of the present invention.

FIG. 4 schematically shows an example of a change in potential of the data line driven by the display driver 30 in the present embodiment. FIG. 4 shows an example of a change in potential of the data line DLn. However, the same description also applies to other data lines.

The display driver 30 (switch control circuit SWC in more detail) electrically connects the output line OL-n with the first power supply line PL1 in a first period T1 by setting the first switching element SW1-*n* to an on-state and setting the second switching element SW2-*n* to an off-state. Therefore, the output line OL-n (output lines OL-1 to OL-N) is electrically disconnected from the second power supply line PL2. This causes the potential of the data line DLn to approach the first power supply voltage PV1 of the first power supply line PL1 in the first period T1.

The display driver 30 electrically connects the output line OL-n with the second power supply line PL2 in a second period T2 after the first period T1 by setting the first switching element SW1-*n* to an off-state and setting the second switching element SW2-*n* to an on-state. Therefore, the output line OL-n (output lines OL-1 to OL-N) is electrically disconnected from the first power supply line PL1. This causes the potential of the data line DLn to approach the second power supply voltage PV2 of the second power supply line PL2 in the second period T2.

The display driver 30 sets the first and second switching elements SW1-*n* and SW2-*n* to an off-state after the second period T2, and drives the output line OL-n using the data line driver circuit DRV-n. Therefore, the output line OL-n (output lines OL-1 to OL-N) is electrically disconnected from the first and second power supply lines PL1 and PL2. This causes the voltage corresponding to the display data to be supplied to the data line DLn after the second period T2.

In FIG. 4, the second period T2 is provided immediately after the first period T1. However, the second period T2 may be provided when a given period of time has elapsed after the first period T1.

As described above, the data lines DL1 to DLN are precharged in each of the first and second periods T1 and T2 before the data lines DL1 to DLN are driven by the data line driver circuits DRV-1 to DRV-N. The voltage corresponding to the display data is supplied to the data lines DL1 to DLN after the second period T2.

This reduces the charge/discharge time of the data line by using the precharge technology, whereby deterioration of the display quality can be prevented. In the present embodiment, since the configuration in which the data line is precharged in two stages is employed, in the case where the second power supply voltage is a system ground power supply voltage, the amount of positive charges flowing from the data line into the system ground power supply line during charging/discharging of the data line can be minimized. Specifically, a precharge method in which the data line is merely connected with the potential provided in advance causes electric charges to flow into the system ground power supply line during charging/discharging of the data line, whereby power consumption is increased. However, according to the present embodiment, since the amount of electric charges flowing into the system ground power supply line can be minimized, power consumption can be reduced.

In the present embodiment, it is desirable that the absolute value AV1 of the difference between the voltage DLV of the data line when the first period T1 is started and the first power supply voltage PV1 be smaller than the absolute value AV2 of the difference between the voltage DLV of the data line when the first period T1 is started and the second power supply voltage PV2, as shown in FIG. 4.

Specifically, in the case of driving the data line at a low potential, the data line is precharged to a higher potential and is then precharged to a lower potential. Therefore, since the period in which positive charges flow toward a lower potential can be reduced, power consumption can be reduced by reutilizing electric charges due to precharging to a higher potential. Moreover, since the data line is precharged to a lower potential before the data line is driven based on the display data, an accurate voltage can be supplied to the data line even if the precharge cycle is reduced, whereby it is possible to deal with an increase in the display size and to prevent deterioration of the display quality.

In the case of driving the data line at a high potential, the data line is precharged to a lower potential and is then precharged to a higher potential. Therefore, since the period in which negative charges flow toward a higher potential can be reduced, power consumption can be reduced by reutilizing electric charges due to precharging to a lower potential. Moreover, since the data line is precharged to a higher potential before the data line is driven based on the display data, an accurate voltage can be supplied to the data line even if the precharge cycle is reduced.

It is desirable that the switch control circuit SWC switch-control so that the first period T1 is longer than the second period T2. Since the amount of electric charges consumed by charging/discharging of the data line can be reduced as described above, power consumption can be further reduced.

The display driver 30 performs the polarity inversion drive which reverses the polarity of the voltage applied to the liquid crystal in order to prevent deterioration of the liquid crystal. The polarity inversion drive reverses the voltage applied to the liquid crystal at timing specified by a polarity inversion signal POL. The polarity inversion signal POL periodically changes corresponding to the cycle of frame reversal drive or line reversal drive.

Figure 5:
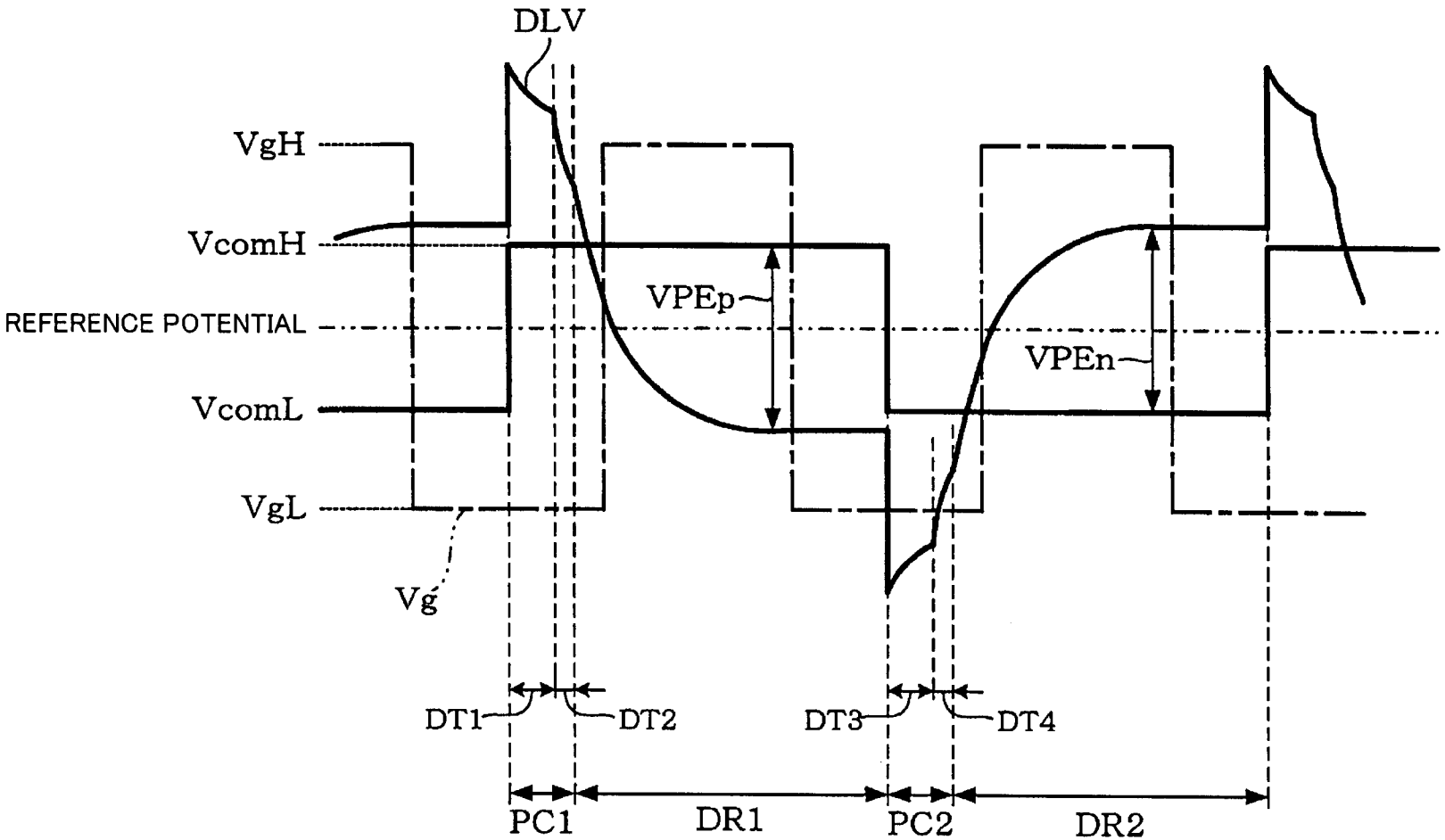
FIG. 5 is a schematic diagram of an example of a change in potential of a data line in the case where polarity inversion drive is realized by a display driver in an embodiment of the present invention.

FIG. 5 schematically shows an example of a change in potential of the data line in the case where the polarity inversion drive is realized by the display driver 30 in the present embodiment. FIG. 5 shows an example of a change in potential of the data line DLn. However, the same description also applies to other data lines.

The common electrode voltage Vcom changes in synchronization with the polarity inversion signal POL. The common electrode voltage Vcom is set at the high-potential-side voltage VcomH when the polarity inversion signal POL is set at a high-potential-side voltage POLH (not shown). The common electrode voltage Vcom is set at the low-potential-side voltage VcomL when the polarity inversion signal POL is set at a low-potential-side voltage POLL (not shown).

In FIG. 5, when the polarity inversion signal POL is set at the high-potential-side voltage POLH, the drive voltage driven by the data line driver circuits DRV-1 to DRV-N shown in FIG. 3 becomes negative with respect to the potential of the common electrode voltage Vcom (given reference potential). In FIG. 5, when the polarity inversion signal POL is set at the low-potential-side voltage POLL, the drive voltage driven by the data line driver circuits DRV-1 to DRV-N shown in FIG. 3 becomes positive with respect to the potential of the common electrode voltage Vcom (given reference potential).

A gate voltage Vg shown in FIG. 5 is supplied to the scan line GLm in the drive period. When the scan lines GL1 to GLM are scanned and the scan line GLm is selected, the gate voltage Vg changes from a low-potential-side gate voltage VgL to a high-potential-side gate voltage VgH. When the gate voltage Vg is set at the high-potential-side gate voltage VgH, the data line DLn is electrically connected with the pixel electrode 26*mn* through the TFT 22*mn* connected with the scan line GLm. Specifically, the data line DLn and the pixel electrode 26*mn* are set at approximately the same potential. The transmittance of the pixel changes corresponding to the voltage applied between the pixel electrode 26*mn* and the common electrode 28*mn*. In FIG. 5, a voltage VPEp in a drive period DR1 and a voltage VPEn in a drive period DR2 correspond to the voltage applied between the pixel electrode 26*mn* and the common electrode 28*mn*.

It is desirable that the potential of the first power supply voltage PV1 be higher than the potential of the second power supply voltage PV2. As the first power supply voltage PV1, the high-potential-side power supply voltage of the data line driver circuits DRV-1 to DRV-N may be used, for example. As the second power supply voltage PV2, the low-potential-side power supply voltage of the data line driver circuits DRV-1 to DRV-N may be used, for example.

In a first precharge period PC1 provided before the drive period in which the polarity is negative and a second precharge period PC2 provided before the drive period in which the polarity is positive, the display driver 30 in the present embodiment performs the above-described precharge operation in divisional periods into which each precharge period is divided.

Specifically, the first precharge period PC1 includes first and second divisional periods DT1 and DT2. The second divisional period DT2 may be provided when a given period has elapsed after the first divisional period DT1. The first precharge period PC1 may be longer than the sum of the first and second divisional periods DT1 and DT2.

Figure 6:
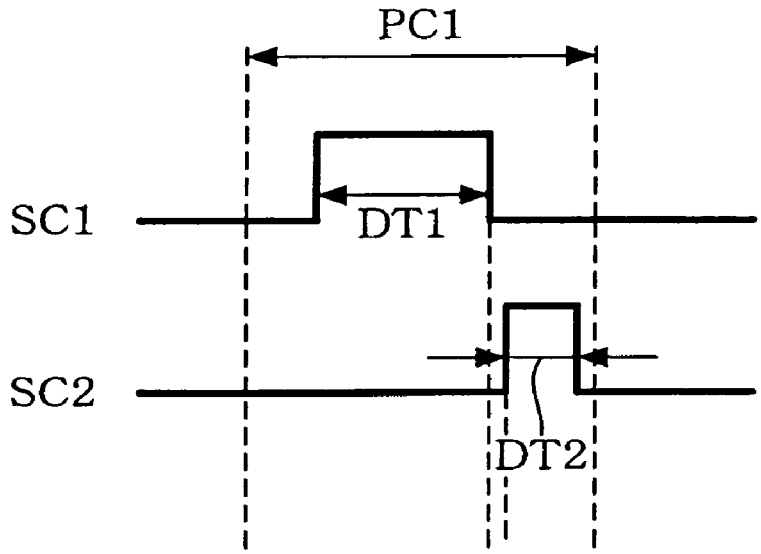
FIG. 6 is an example of a timing diagram of first and second switch control signals in a first precharge period.

FIG. 6 shows an example of a timing diagram of the first and second switch control signals SC1 and SC2 in the first precharge period PC1.

The first switch control signal SC1 generated by the switch control circuit SWC is input in common to the first switching elements SW1-1 to SW1-N. The first switching elements SW1-1 to SW1-N are ON-OFF controlled based on the first switch control signal SC1. The first switching elements SW1-1 to SW1-N are turned ON when the first switch control signal SC1 is set at a logical level H. The first switching elements SW1-1 to SW1-N are turned OFF when the first switch control signal SC1 is set at a logical level L. Therefore, the period in which the first switch control signal SC1 is set at a logical level H corresponds to the first divisional period DT1.

The second switch control signal SC2 generated by the switch control circuit SWC is input in common to the second switching elements SW2-1 to SW2-N. The second switching elements SW2-1 to SW2-N are ON-OFF controlled based on the second switch control signal SC2. The second switching elements SW2-1 to SW2-N are turned ON when the second switch control signal SC2 is set at a logical level H. The second switching elements SW2-1 to SW2-N are turned OFF when the second switch control signal SC2 is set at a logical level L. Therefore, the period in which the second switch control signal SC2 is set at a logical level H corresponds to the second divisional period DT2.

In the present embodiment, the first divisional period DT1 and the second divisional period DT2 after the first divisional period DT1 are set in the first precharge period PC1 by the first and second switch control signals SC1 and SC2.

The following description focuses on the data line DLn.

The switch control circuit SWC sets the first switching element SW1-*n* to an on-state and sets the second switching element SW2-*n* to an off-state in the first divisional period DT1 in the first precharge period PC1. Specifically, the same state as in the first period T1 shown in FIG. 4 is created.

The common electrode voltage Vcom is set at the high-potential-side common electrode voltage VcomH in the drive period in which the polarity of the liquid crystal reversal drive is negative. This causes the voltage of the data line DLn with respect to the common electrode voltage Vcom to be relatively increased. This increases the difference between the voltage of the data line DLn and the voltage which should be supplied to the data line DLn in the drive period in which the polarity of the liquid crystal reversal drive is negative, whereby the period of time necessary for the voltage of the data line DLn to reach the voltage which should be supplied to the data line DLn is increased. Therefore, the data line DLn is precharged in the first divisional period DT1 by connecting the data line DLn with the high-potential-side first power supply voltage PV1. This causes electric charges (positive charges) from the data line to flow into the first power supply line PL1 to which the first power supply voltage PV1 is supplied. This enables the electric charges to be reutilized, whereby power consumption can be reduced.

In the second divisional period DT2 after the first divisional period DT1, the switch control circuit SWC sets the first switching element SW1-*n* to an off-state and sets the second switching element SW2-*n* to an on-state. Specifically, the same state as in the second period T2 shown in FIG. 4 is created.

In the second divisional period DT2, the data line DLn is precharged by connecting the data line DLn with the low-potential-side second power supply voltage PV2. This causes electric charges from the data line to flow into the second power supply line PL2 to which the second power supply voltage PV2 is supplied, whereby power consumption is increased. However, the voltage of the data line DLn can be promptly set at or near a desired voltage.

In the first drive period DR1 after the second divisional period DT2 (after the first precharge period PC1), the data line DLn is driven by the data line driver circuit DRV-n based on the drive voltage corresponding to the display data. In this case, since it suffices that the data line be charged or discharged from the voltage set in the second divisional period DT2, the amount of charging/discharging of the data line accompanying supply of the drive voltage based on the display data can be reduced.

In the present embodiment, it is desirable that the first divisional period DT1 be longer than the second divisional period DT2. This reduces the period in which electric charges from the data line flow into the second power supply line PL2 to which the second power supply voltage PV2 is supplied, whereby power consumption can be reduced.

The second precharge period PC2 includes third and fourth divisional periods DT3 and DT4. The fourth divisional period DT4 may be provided when a given period has elapsed after the third divisional period DT3. The second precharge period PC2 may be longer than the sum of the third and fourth divisional periods DT3 and DT4.

Figure 7:
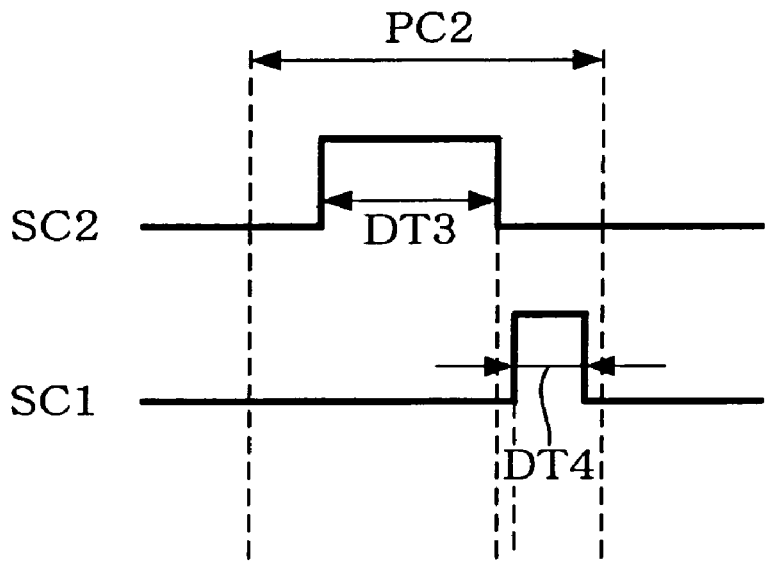
FIG. 7 is an example of a timing diagram of first and second switch control signals in a second precharge period.

FIG. 7 shows an example of a timing diagram of the first and second switch control signals SC1 and SC2 in the second precharge period PC2.

In the second precharge period PC2, the period in which the second switch control signal SC2 is set at a logical level H corresponds to the third divisional period DT3. In the second precharge period PC2, the period in which the first switch control signal SC1 is set at a logical level H corresponds to the fourth divisional period DT4.

In the present embodiment, the third divisional period DT3 and the fourth divisional period DT4 after the third divisional period DT3 are set in the second precharge period PC2 by the first and second switch control signals SC1 and SC2.

In the third divisional period DT3 in the second precharge period PC2, the switch control circuit SWC sets the first switching element SW1-*n* to an off-state and sets the second switching element SW2-*n* to an on-state. Specifically, the same state as in the first period T1 shown in FIG. 4 is created.

The common electrode voltage Vcom is set at the low-potential-side common electrode voltage VcomL in the drive period in which the polarity of the liquid crystal reversal drive is positive. This causes the voltage of the data line DLn with respect to the common electrode voltage Vcom to be relatively decreased. This increases the difference between the voltage of the data line DLn and the voltage which should be supplied to the data line DLn in the drive period in which the polarity of the liquid crystal reversal drive is positive, whereby the period of time necessary for the voltage of the data line DLn to reach the voltage which should be supplied to the data line DLn is increased. Therefore, in the third divisional period DT3, the data line DLn is precharged by connecting the data line DLn with the low-potential-side second power supply voltage PV2. This causes electric charges (negative charges) from the data line to flow into the second power supply line PL2 to which the second power supply voltage PV2 is supplied. This enables electric charges to be reutilized, whereby power consumption can be reduced.

In the fourth divisional period DT4 after the third divisional period DT3, the control circuit SWC sets the first switching element SW1-*n* to an on-state and sets the second switching element SW2-*n* to an off-state. Specifically, the same state as in the second period T2 shown in FIG. 4 is created.

In the fourth divisional period DT4, the data line DLn is precharged by connecting the data line DLn with the high-potential-side first power supply voltage PV1. This causes electric charges from the data line to flow into the second power supply line PL2 to which the second power supply voltage PV2 is supplied, whereby power consumption is increased. However, the voltage of the data line DLn can be promptly set at or near a desired voltage. This reduces the amount of charging/discharging of the data line accompanying supply of the drive voltage based on the display data.

In the second drive period DR2 after the fourth divisional period DT4 (after the second precharge period PC2), the data line DLn is driven by the data line driver circuit DRV-n based on the drive voltage corresponding to the display data. In this case, since it suffices that the data line be charged or discharged from the voltage set in the fourth divisional period DT4, the amount of charging/discharging of the data line accompanying supply of the drive voltage based on the display data can be reduced.

In the present embodiment, it is desirable that the third divisional period DT3 be longer than the fourth divisional period DT4. This reduces the period in which electric charges from the data line flow into the first power supply line PL1 to which the first power supply voltage PV1 is supplied, whereby power consumption can be reduced.

In FIG. 5, the first and second precharge periods PC1 and PC2 are started at the change point of the common electrode voltage Vcom. However, the present invention is not limited thereto. The first and second precharge periods PC1 and PC2 may be started before the change point of the common electrode voltage Vcom.

Figure 8:
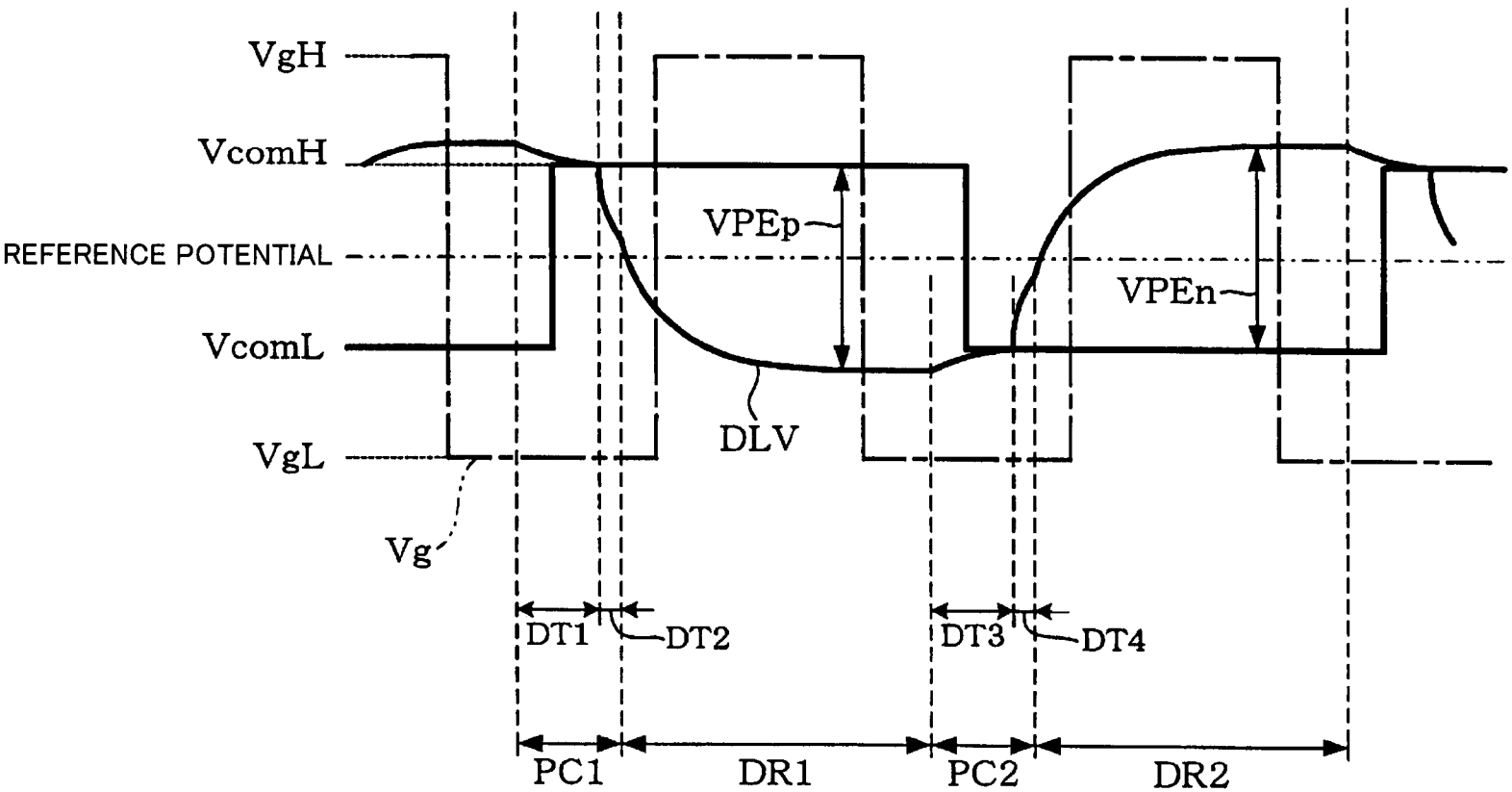
FIG. 8 is a schematic diagram of another example of a change in potential of a data line in the case where polarity inversion drive is realized by a display driver in an embodiment of the present invention.

FIG. 8 schematically shows another example of a change in potential of the data line in the case where the polarity inversion drive is realized by the display driver 30 in the present embodiment. FIG. 8 shows an example of a change in potential of the data line DLn. However, the same description also applies to other data lines.

In this case, the first divisional period DT1 in the first precharge period PC1 and the third divisional period DT3 in the second precharge period PC2 can be increased in comparison with the case shown in FIG. 5. Therefore, the second divisional period DT2 in the first precharge period PC1 and the fourth divisional period DT4 in the second precharge period PC2 can be reduced to that extent. This increases the period in which electric charges are reutilized and reduces the period in which electric charges are not reutilized, whereby power consumption can be further reduced.

3. Configuration Example of Display Driver

Figure 9:
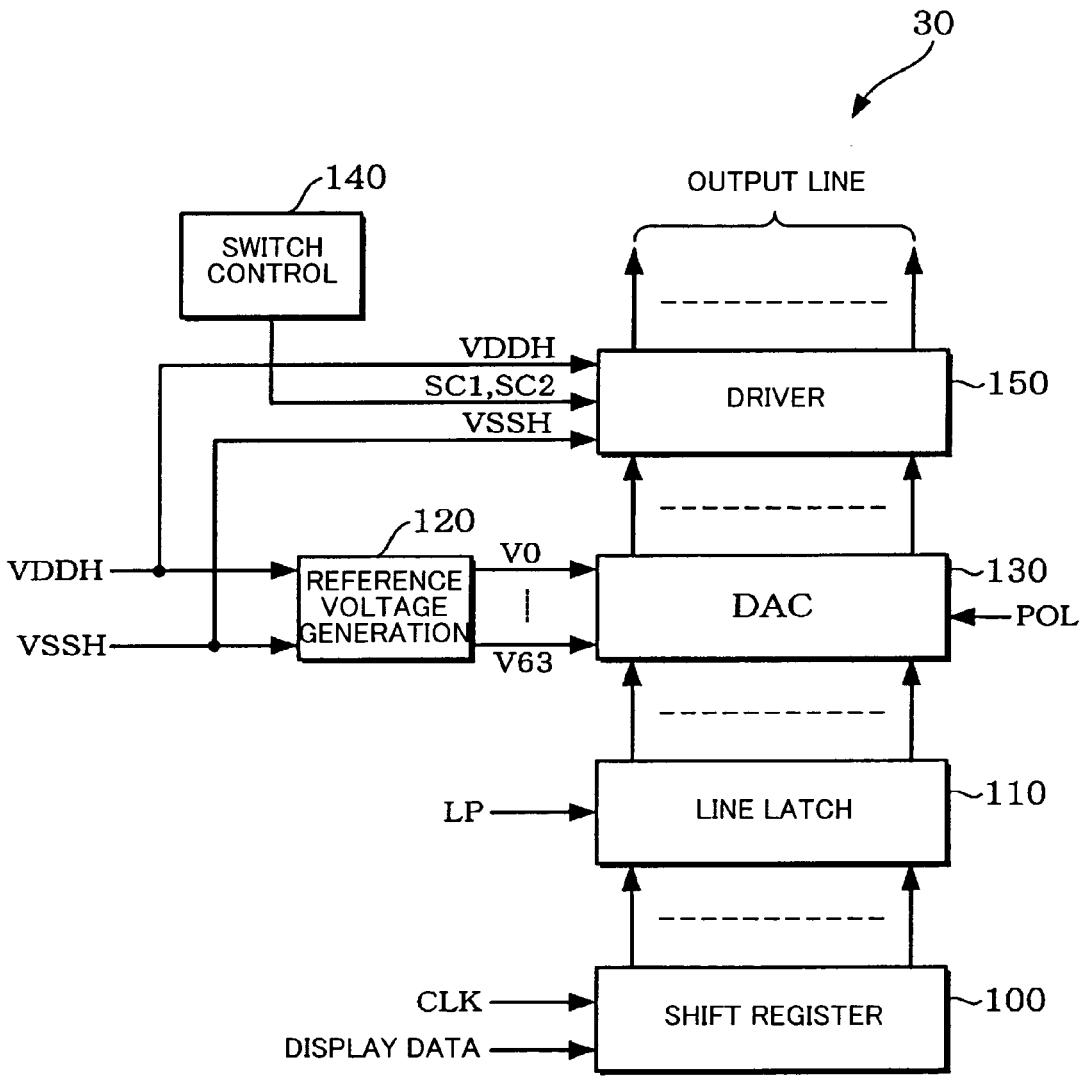
FIG. 9 is a block diagram of a configuration example of a display driver in an embodiment of the present invention.

FIG. 9 shows a block diagram of a configuration example of the display driver 30.

The display driver 30 includes a shift register 100, a line latch 110, a reference voltage generation circuit 120, a digital/analog converter (DAC) 130 (voltage select circuit in a broad sense), a switch control circuit 140, and a driver circuit 150.

The shift register 100 fetches the display data for one horizontal scanning period by shifting the display data input in series in pixel units in synchronization with a clock signal CLK, for example. The clock signal CLK is supplied from the display controller 38.

In the case where one pixel is made up of an R signal, G signal, and B signal, six bits each, one pixel is made up of 18 bits.

The display data fetched in the shift register 100 is latched by the line latch 110 at timing of a latch pulse signal LP. The latch pulse signal LP is input at a horizontal scanning cycle timing.

The reference voltage generation circuit 120 generates a plurality of reference voltages, each of the reference voltages corresponding to the display data. In more detail, the reference voltage generation circuit 120 generates a plurality of reference voltages V0 to V6, each of which corresponds to the 6-bit display data, based on the high-potential-side system power supply voltage VDDH and the low-potential-side system ground power supply voltage VSSH.

The DAC 130 generates the drive voltage corresponding to the display data output from the line latch 110 in output line units. In more detail, the DAC 130 selects the reference voltage corresponding to the display data for one output line output from the line latch 110 from the reference voltages V0 to V63 generated by the reference voltage generation circuit 120, and outputs the selected reference voltage as the drive voltage.

The driver circuit 150 drives a plurality of output lines, each of the output lines being connected with one of the data lines of the display panel 20. In more detail, the driver circuit 150 drives each output line based on the drive voltage generated by the DAC 130 in output line units. The driver circuit 150 drives each output line by the data line driver circuits DRV-1 to DRV-N shown in FIG. 3. The data line driver circuits DRV-1 to DRV-N are formed by voltage-follower-connected operational amplifiers. The first and second switching elements are provided for each output line as shown in FIG. 3. In FIG. 9, the high-potential-side system power supply voltage VDDH is used as the first power supply voltage PV1. The low-potential-side system ground power supply voltage VSSH is used as the second power supply voltage PV2. In this case, the first power supply voltage PV1 is the high-potential-side power supply voltage of the data line driver circuits DRV-1 to DRV-N, and the second power supply voltage PV2 is the low-potential-side power supply voltage of the data line driver circuits DRV-1 to DRV-N.

The switch control circuit 140 corresponds to the control circuit SWC shown in FIG. 3, and generates the first and second control signals SC1 and SC2. The first switch control signal SC1 is used to control the first switching elements SW1-1 to SW1-N provided in the driver circuit 150. The second switch control signal SC2 is used to control the second switching elements SW2-1 to SW2-N provided in the driver circuit 150.

In the display driver 30 having the above-described configuration, the display data for one horizontal scanning period fetched by the shift register 100 is latched by the line latch 110, for example. The drive voltage is generated in output line units by using the display data latched by the line latch 110. The driver circuit 150 drives each output line based on the drive voltage generated by the DAC 130. In this case, the output line is driven while reversing the polarity of the voltage applied to the liquid crystal in synchronization with the polarity inversion signal POL while precharging the output line in two stages in each precharge period.

Figure 10:
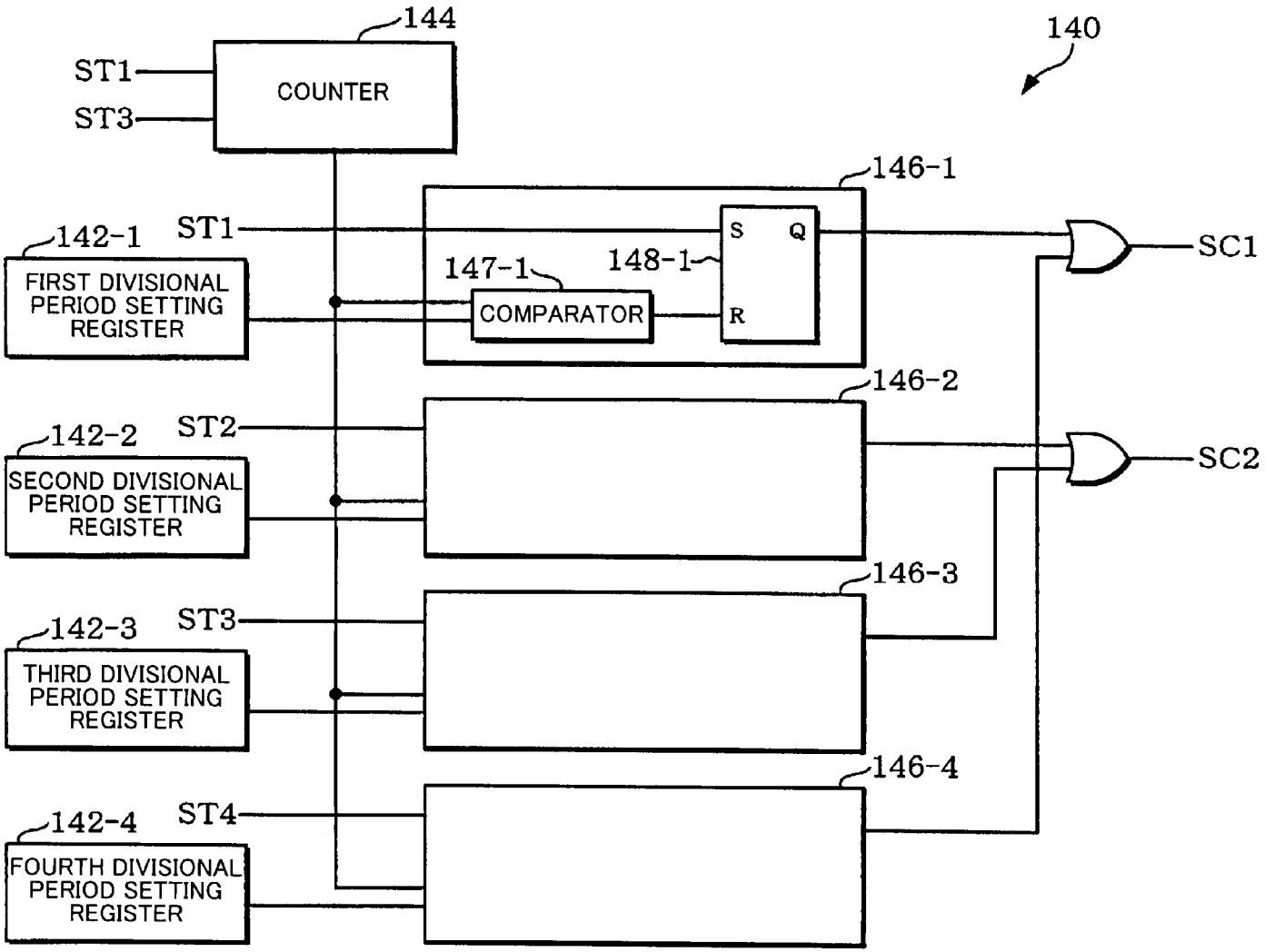
FIG. 10 is a block diagram of a configuration example of a switch control circuit.

FIG. 10 shows a configuration example of the switch control circuit 140.

The switch control circuit 140 includes first to fourth divisional period setting registers 142-1 to 142-4. The first switch control signal SC1 having a pulse width corresponding to the value set in the first divisional period setting register 142-1 or the fourth divisional period setting register 142-4 is generated as shown in FIG. 6 or 7. The second switch control signal SC2 having a pulse width corresponding to the value set in the second divisional period setting register 142-2 or the third divisional period setting register 142-3 is generated as shown in FIG. 6 or 7. The values set in the first to fourth divisional period setting registers 142-1 to 142-4 are set by the display controller 38.

The switch control circuit 140 includes a counter 144 and control signal generation circuits 146-1 to 146-4. The counter 144 counts up in synchronization with a given clock signal. The switch control signal generation circuit 146-1 generates the first switch control signal SC1 which specifies the first divisional period DT1. The switch control signal generation circuit 146-2 generates the second switch control signal SC2 which specifies the second divisional period DT2. The switch control signal generation circuit 146-3 generates the second switch control signal SC2 which specifies the third divisional period DT3. The switch control signal generation circuit 146-4 generates the first switch control signal SC1 which specifies the fourth divisional period DT4.

The switch control signal generation circuit 146-1 includes a comparator 147-1 and an RS flip-flop 148-1, for example. The comparator 147-1 compares the counter value of the counter 144 with the value set in the first divisional period setting register 142-1, and outputs a pulse when these values coincide. The RS flip-flop 148-1 is set by the first start signal ST1, and is reset when the comparator 147-1 detects that the counter value of counter 144 coincides with the value set in the first divisional period setting register 142-1. This configuration allows start of the first divisional period DT1 to be designated by the first start signal ST1 and the length of the first divisional period DT1 to be designated by the value set in the first divisional period setting register 142-1.

The switch control signal generation circuits 146-1 to 146-4 have the same configuration. Therefore, description of the switch control signal generation circuits 146-2 to 146-4 is omitted.

The first and third start signals ST1 and ST3 may be output at timing determined in advance as timing dependent on the display panel 20 as the drive target or the like, or may be output at timing set by the display controller 38. The start time of the precharge period shown in FIG. 5 or 8 may be designated by the first and third start signals ST1 and ST3.

The second and fourth start signals ST2 and ST4 are determined depending on the display panel 20 as the drive target or the like. Power consumption can be reduced by reducing the second and fourth divisional periods DT2 and DT4. There may be a case where the voltage of the data line cannot be set in time if the second and fourth divisional periods DT2 and DT4 are excessively increased.

Figure 11:
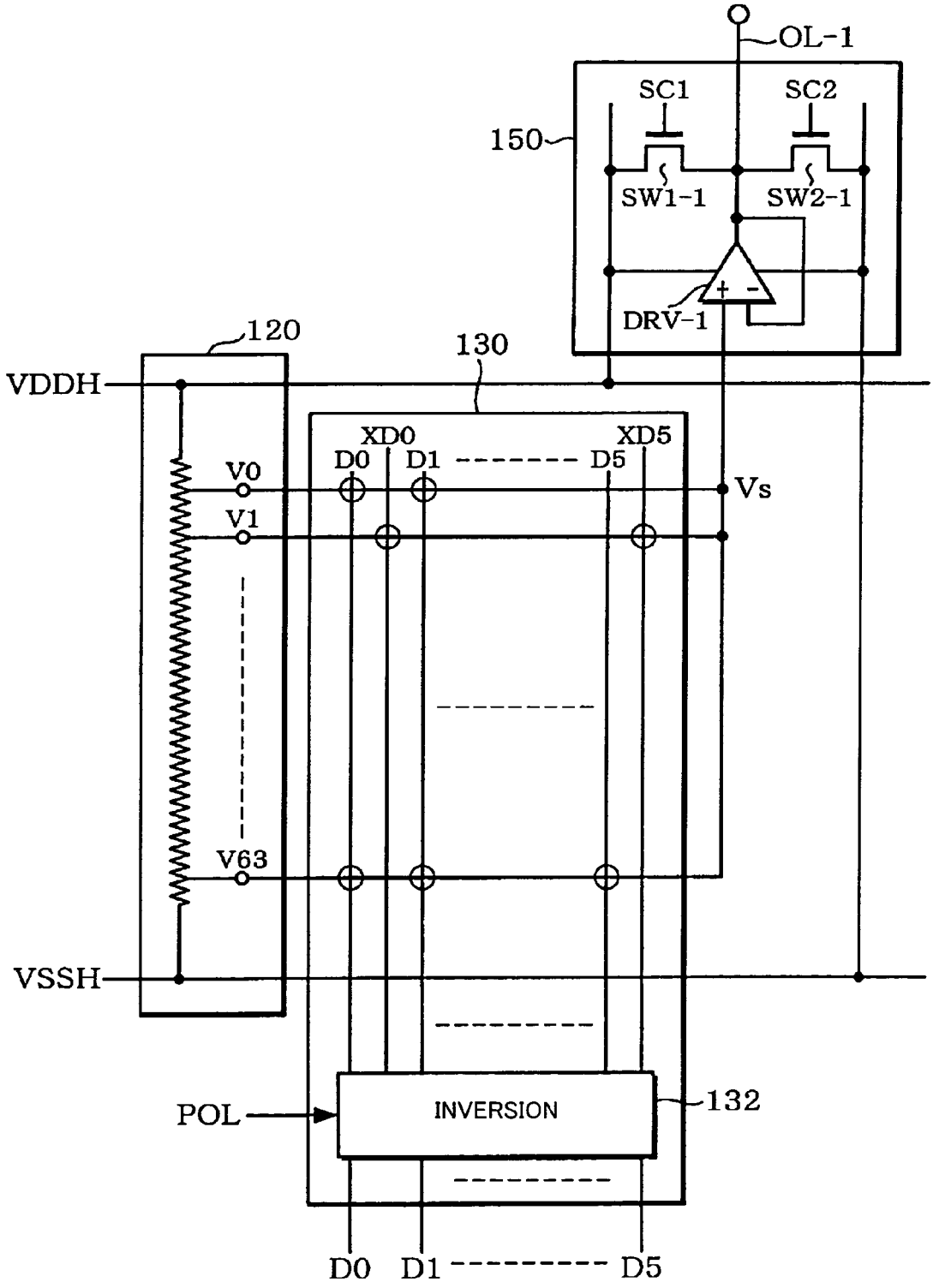
FIG. 11 is a circuit diagram showing a connection relationship among a reference voltage generation circuit, a DAC, and a driver circuit.

FIG. 11 shows an outline of a configuration of the reference voltage generation circuit 120, the DAC 130, and the driver circuit 150. FIG. 11 illustrates only the data line driver circuit DRV-1 of the driver circuit 150. However, the same description also applies to other driver circuits.

In the reference voltage generation circuit 120, a resistor circuit is connected between the system power supply voltage VDDH and the system ground power supply voltage VSSH. The reference voltage generation circuit 120 generates a plurality of divided voltages obtained by dividing the voltage between the system power supply voltage VDDH and the system ground power supply voltage VSSH using the resistor circuit as the reference voltages V0 to V63. In the polarity inversion drive, since the voltage is not symmetrical between the case where the polarity is positive and the case where the polarity is negative, a positive reference voltage and a negative reference voltage are generated. FIG. 11 shows one of them.

The DAC 130 may be realized by a ROM decoder circuit. The DAC 130 selects one of the reference voltages V0 to V63 based on the 6-bit display data, and outputs the selected reference voltage to the data line driver circuit DRV-1 as the select voltage Vs. The voltage selected based on the corresponding 6-bit display data is output to other data line driver circuits DRV-2 to DRV-N.

The DAC 130 includes an inversion circuit 132. The inversion circuit 132 reverses the display data based on the polarity inversion signal POL. The 6-bit display data D0 to D5 and 6-bit reversed display data XD0 to XD5 are input to the DAC 130. The reversed display data XD0 to XD5 is obtained by reversing the display data D0 to D5, respectively. In the DAC 130, one of the multi-valued reference voltages V0 to V63 generated by the reference voltage generation circuit is selected based on the display data.

When the logical level of the polarity inversion signal POL is H, the reference voltage V2 is selected corresponding to the 6-bit display data D0 to D5 "000010" (=2), for example. When the logical level of the polarity inversion signal POL is L, the reference voltage is selected by using the reversed display data XD0 to XD5 obtained by reversing the display data D0 to D5. Specifically, the reversed display data XD0 to XD5 becomes "111101" (=61), whereby the reference voltage V61 is selected.

The select voltage Vs selected by the DAC 130 is supplied to the data line driver circuit DRV-1.

After the output line OL-1 is precharged in the divisional periods designated by the first and second switch control signals SC1 and SC2, the data line driver circuit DRV-1 drives the output line OL-I based on the select voltage Vs.

Figure 12:
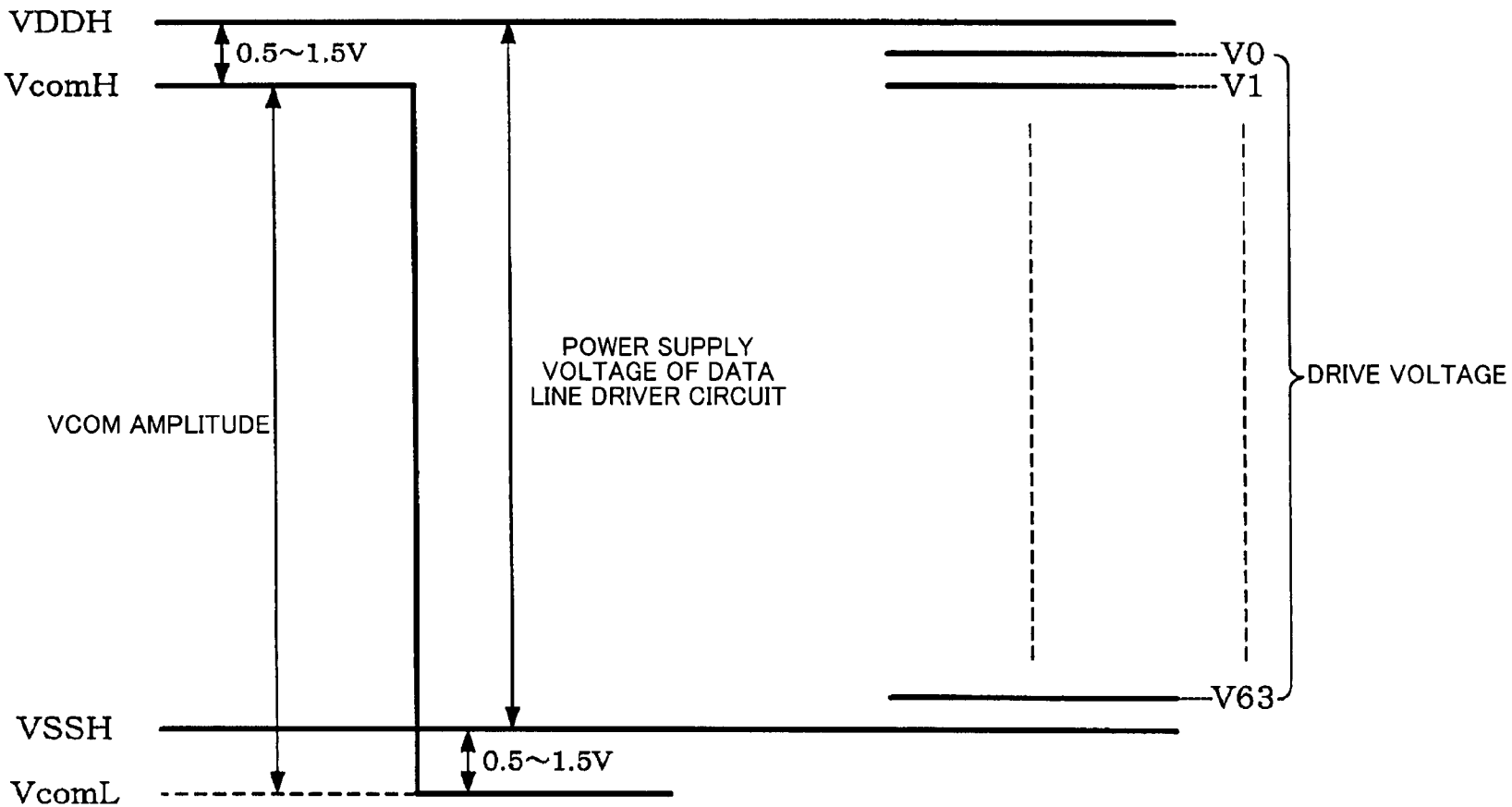
FIG. 12 is a schematic diagram of a voltage relationship example in an embodiment of the present invention.

FIG. 12 schematically shows a voltage relationship example in the present embodiment. In the present embodiment, the high-potential-side voltage VcomH of the common electrode voltage Vcom is about 0.5 to 1.5 V lower than the high-potential-side system power supply voltage VDDH. The low-potential-side voltage VcomL of the common electrode voltage Vcom is about 0.5 to 1.5 V lower than the low-potential-side system ground power supply voltage VSSH.

The high-potential-side system power supply voltage VDDH and the low-potential-side system ground power supply voltage VSSH are respectively used as the high-potential-side power supply voltage and the low-potential-side power supply voltage of the data line driver circuits DRV-1 to DRV-N. In FIG. 11, the first power supply voltage PV1 connected with the first switching elements SW1-1 to SW1-N is the high-potential-side power supply voltage of the data line driver circuits DRV-1 to DRV-N. The second power supply voltage PV2 connected with the second switching elements SW2-1 to SW2-N is the low-potential-side power supply voltage of the data line driver circuits DRV-1 to DRV-N.

The first power supply voltage PV1 connected with the first switching elements SW1-1 to SW1-N is not limited to the high-potential-side power supply voltage of the data line driver circuits DRV-1 to DRV-N.

The second power supply voltage PV2 connected with the second switching elements SW2-1 to SW2-N is not limited to the low-potential-side power supply voltage of the data line driver circuits DRV-1 to DRV-N.

Figure 13:
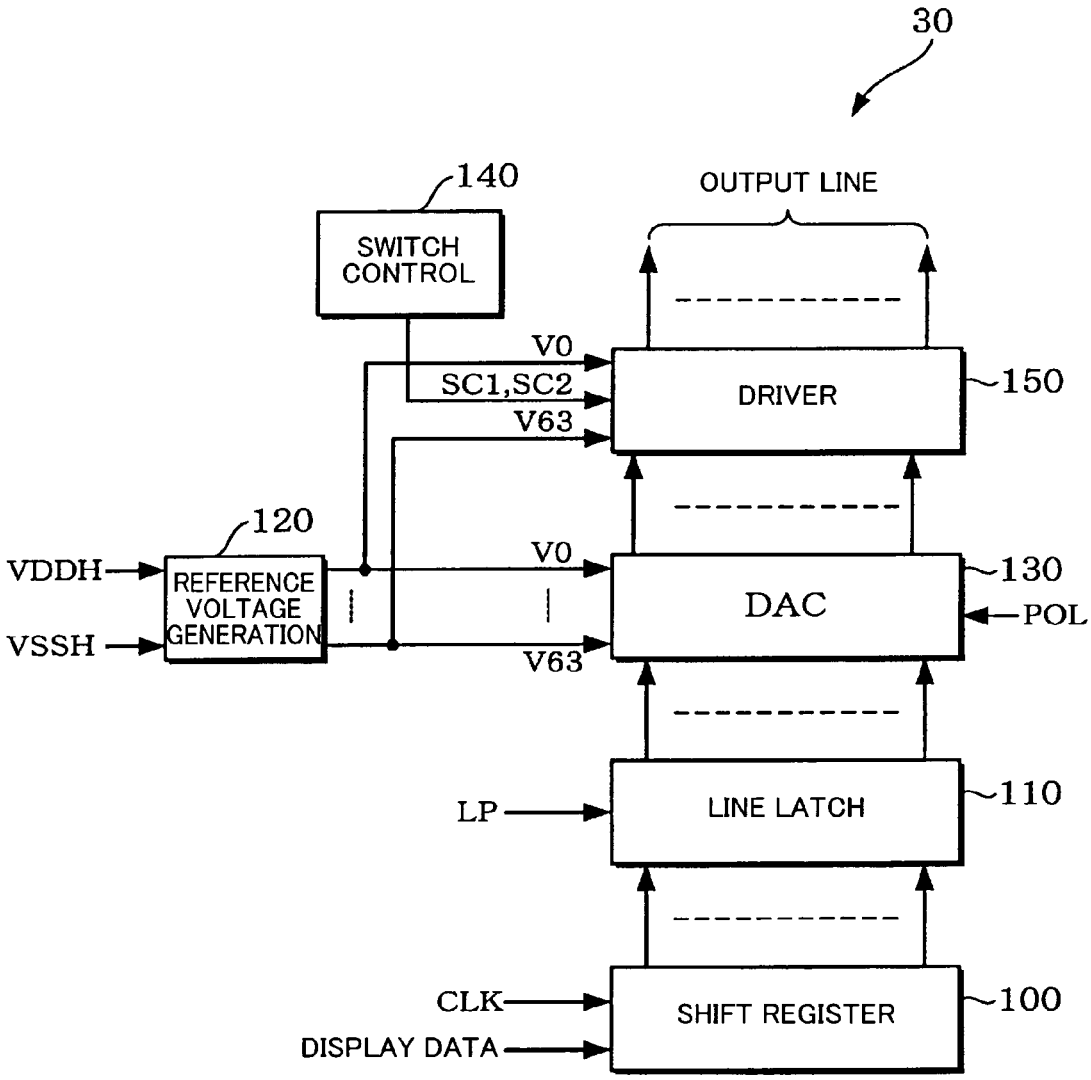
FIG. 13 is a block diagram of another configuration example of a display driver.

FIG. 13 shows a block diagram of another configuration example of the display driver 30. In FIG. 13, sections the same as the sections shown in FIG. 9 are denoted by the same symbols. Description of these sections is appropriately omitted. The display driver in FIG. 13 differs from the display driver in FIG. 9 in the first and second power supply voltages connected with the first and second switching elements of the driver circuit 150.

Figure 14:
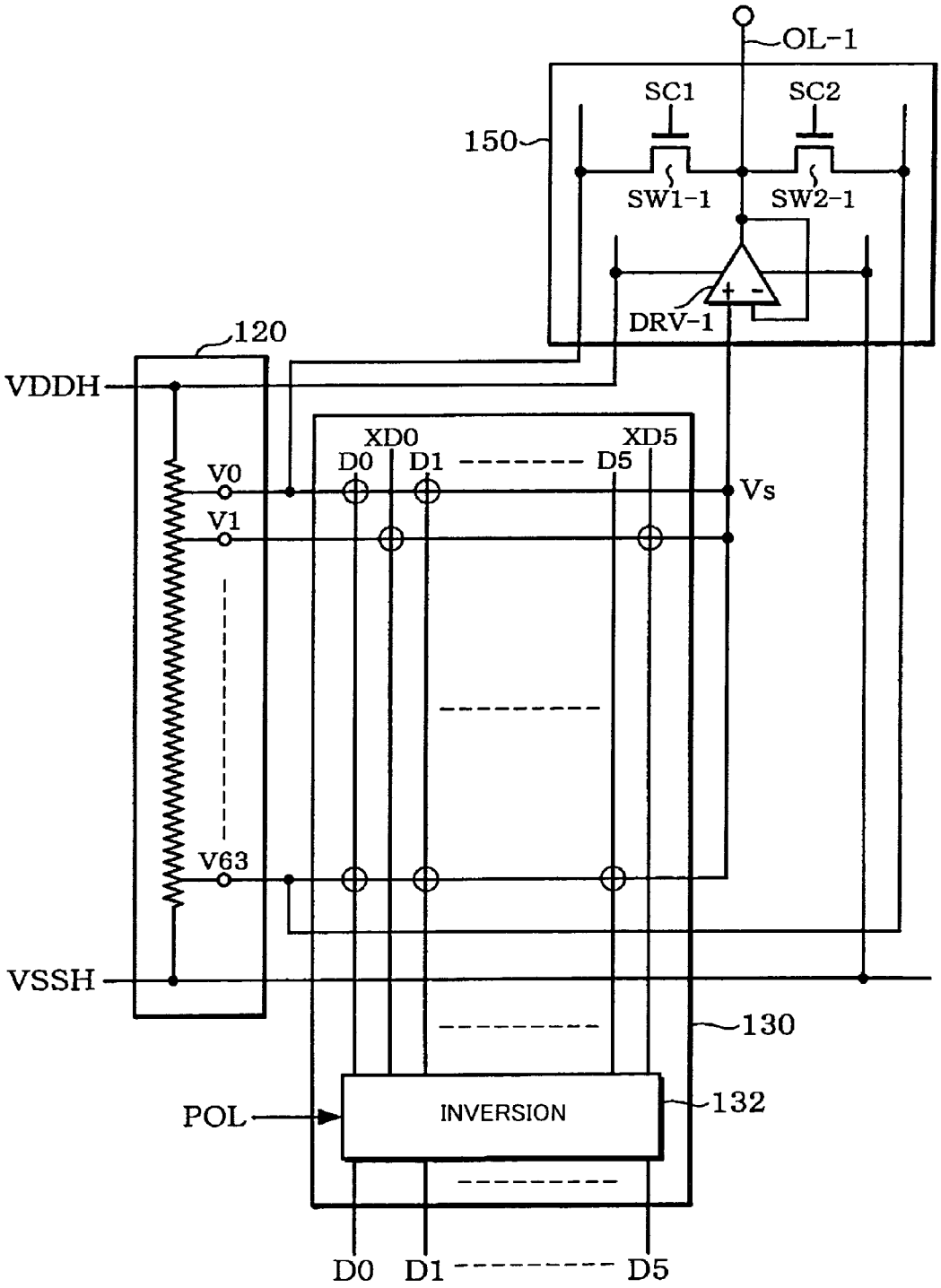
FIG. 14 is a circuit diagram showing another connection example among a reference voltage generation circuit, a DAC, and a driver circuit.

FIG. 14 shows an outline of a configuration of the reference voltage generation circuit 120, the DAC 130, and the driver circuit 150 shown in FIG. 13. In FIG. 14, sections the same as the sections shown in FIG. 11 are denoted by the same symbols. Description of these sections is appropriately omitted.

The first power supply voltage PV1 is the reference voltage V0 (maximum value of the drive voltage) which is the highest voltage of the reference voltages V0 to V63. The second power supply voltage PV2 is the reference voltage V63 (minimum value of the drive voltage) which is the lowest voltage of the reference voltages V0 to V63.

In this case, the high-potential-side power supply voltage of the data line driver circuit DRV-1 is the system power supply voltage VDDH, and the low-potential-side power supply voltage of the data line driver circuit DRV-1 is the system ground power supply voltage VSSH. This is because a margin is necessary in the case of driving the output line based on the reference voltages V0 and V63 generated by the reference voltage generation circuit 120.

4. Other Display Device

The case where the display driver in the present embodiment is applied to a display panel formed by using a low-temperature poly-silicon (hereinafter abbreviated as "LTPS") process is described below.

According to the LTPS process, a driver circuit can be directly formed on a panel substrate (glass substrate, for example) on which a pixel including a TFT is formed, for example. This reduces the number of parts, whereby the size and weight of the display panel can be reduced. Moreover, LTPS enables the pixel size to be reduced by applying a conventional silicon process technology while maintaining the aperture ratio. Furthermore, LTPS has high charge mobility and small parasitic capacitance in comparison with amorphous silicon (a-Si). Therefore, the charge period of the pixel formed on the substrate can be secured even if the pixel select period for one pixel is reduced due to an increase in the screen size, whereby the image quality can be improved.

Figure 15:
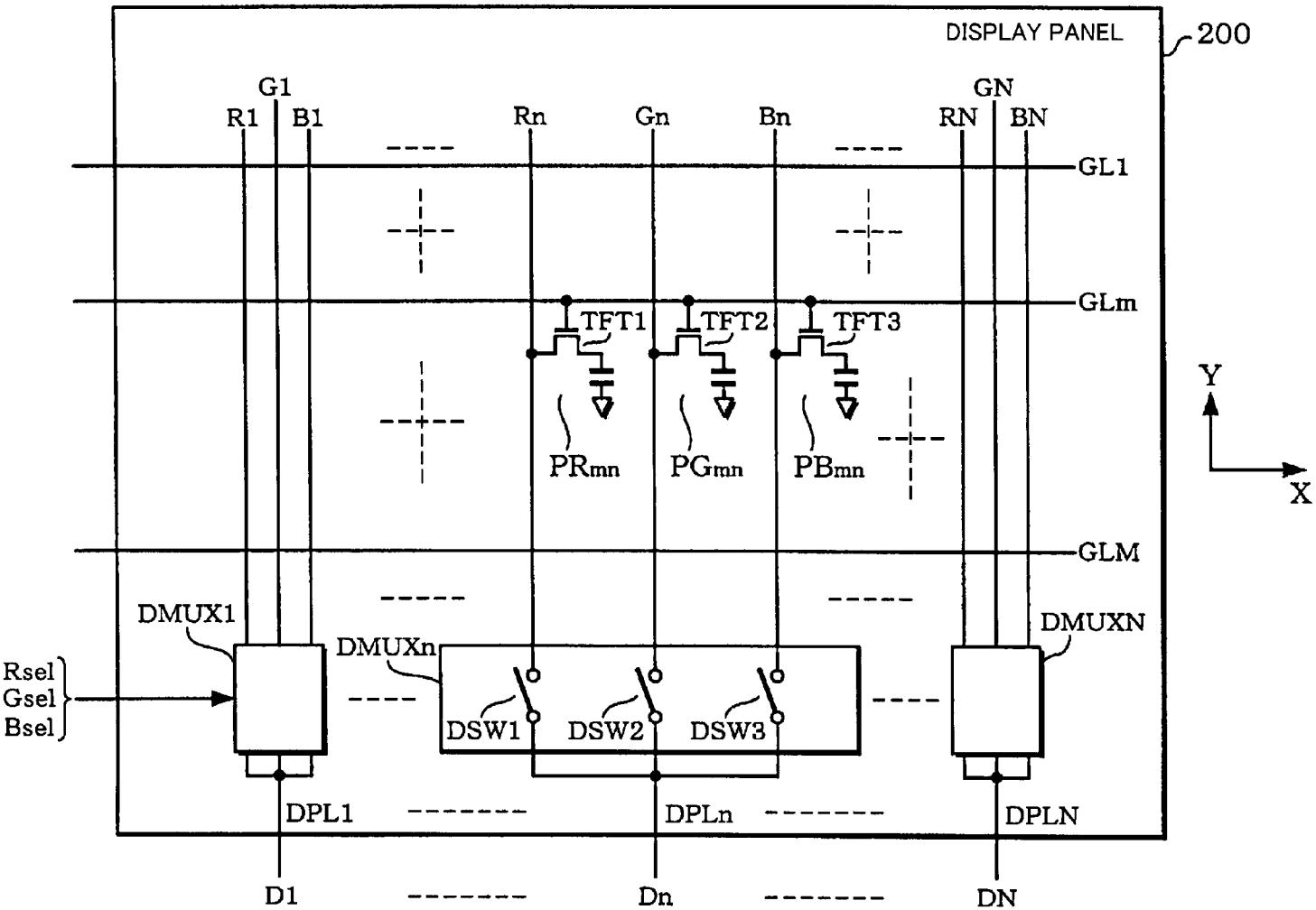
FIG. 15 is a diagram showing an outline of a configuration of a display panel formed by using an LTPS process.

FIG. 15 shows an outline of a configuration of a display panel formed by using the LTPS process. A display panel 200 (electro-optical device in a broad sense) includes a plurality of scan lines, a plurality of color component data lines (data lines in a broad sense), and a plurality of pixels. The scan lines and the color component data lines are disposed to intersect. A pixel is specified by the scan line and the color component data line.

In the display panel 200, the pixels are selected by the scan line (GL) and the data signal supply line (DPL) in three pixel units. A color component signal transmitted through one of the three color component data lines (R, G, B) (data lines in a broad sense) corresponding to the data signal supply line is written in the selected pixel. Each pixel includes a TFT and a pixel electrode. The data signal supply line is connected with the output line of the display driver.

In the display panel 200, a plurality of scan lines GL1 to GLM, arranged in the Y direction and extending in the X direction, and a plurality of data signal supply lines DPL1 to DPLN, arranged in the X direction and extending in the Y direction, are formed on the panel substrate. A plurality of sets of first to third color component data lines (R1, G1, B1) to (RN, GN, BN), arranged in the X direction and extending in the Y direction, are formed on the panel substrate.

R pixels (first color component pixels) PR (PR11 to PRMN) are formed at the intersecting points of the scan lines GL1 to GLM and the first color component data lines R1 to RN. G pixels (second color component pixels) PG (PG11 to PGMN) are formed at the intersecting points of the scan lines GL1 to GLM and the second color component data lines G1 to GN. B pixels (third color component pixels) PB (PB11 to PBMN) are formed at the intersecting points of the scan lines GL1 to GLM and the third color component data lines B1 to BN.

Demultiplexers DMUX1 to DMUXN are provided on the panel substrate corresponding to the data signal supply line. The demultiplexers DMUX1 to DMUXN are controlled by demultiplex control signals Rsel, Gsel, and Bsel.

Figure 16:
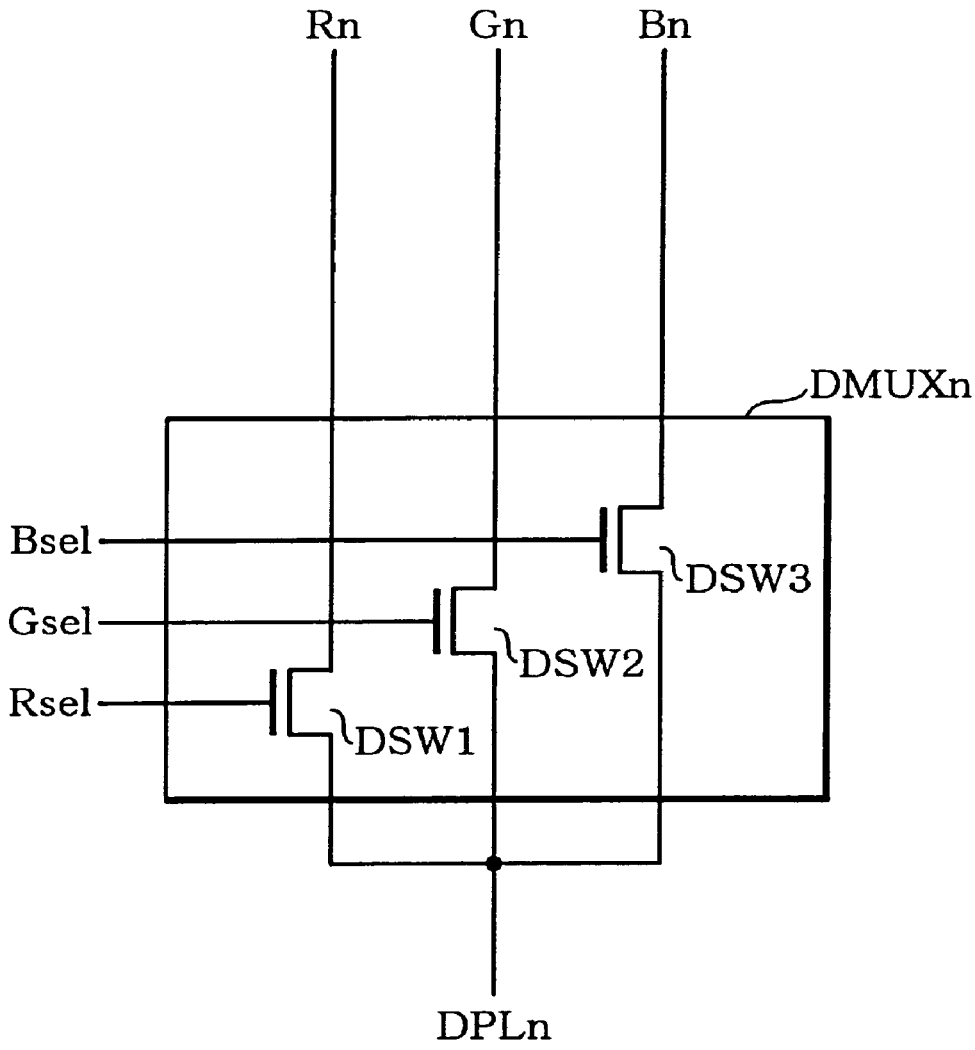
FIG. 16 is a diagram showing an outline of a configuration of a demultiplexer.

FIG. 16 shows an outline of a configuration of the demultiplexer DMUXn.

The demultiplexer DMUXn includes first to third demultiplex switching elements DSW1 to DSW3.

The first to third color component data lines (Rn, Gn, Bn) are connected with the output side of the demultiplexer DMUXn. The data signal supply line DPLn is connected with the input side of the demultiplexer DMUXn. The demultiplexer DMUXn electrically connects the data signal supply line DPLn with one of the first to third color component data lines (Rn, Gn, Bn) in response to the demultiplex control signals Rsel, Gsel, and Bsel. The demultiplex control signals are input in common to the demultiplexers DMUX1 to DMUXN.

The demultiplex control signals Rsel, Gsel, and Bsel are supplied from the display driver provided outside the display panel 200, for example. In this case, the display driver outputs voltages (data signals), which are time-divided in units of color component pixels and correspond to the display data for each color component, to the data signal supply line DPLn. The display driver generates the demultiplex control signals Rsel, Gsel, and Bsel for selectively outputting the voltage corresponding to the display data for each color component to each color component data line in synchronization with the time-division timing, and outputs the demultiplex control signals to the display panel 200.

The precharge technology in the present embodiment can also be applied to such a display panel 200.

Figure 18:
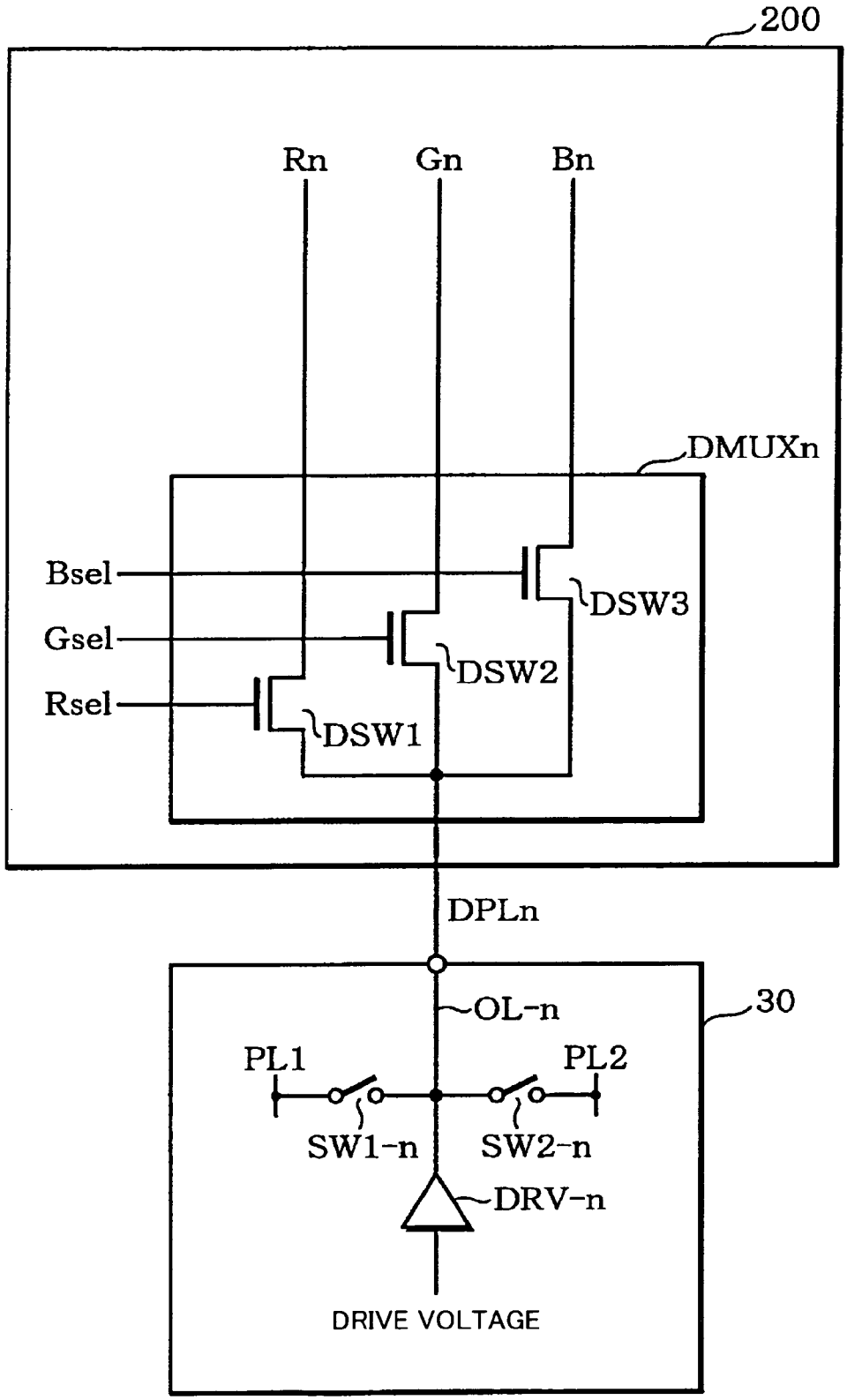
FIG. 18 is a block diagram of an essential portion of a configuration in the case where a display driver in an embodiment of the present invention is applied to the display panel shown in FIG. 15.

FIG. 18 shows a block diagram of an essential portion of a configuration in the case where the display driver 30 is applied to the display panel 200.

In FIG. 18, sections the same as the sections shown in FIGS. 3 and 16 are denoted by the same symbols. Description of these sections is appropriately omitted.

Figure 19:
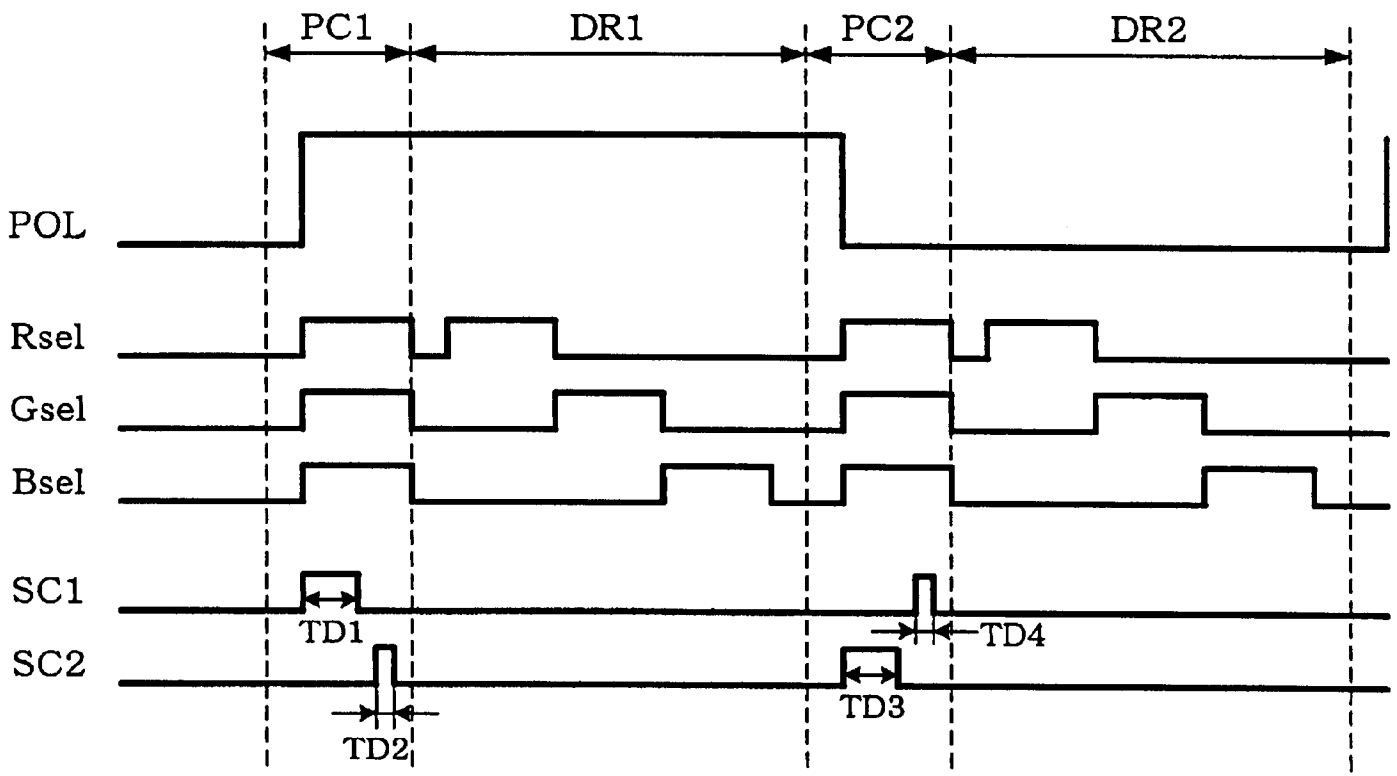
FIG. 19 is a diagram showing an example of timing of precharging using the configuration shown in FIG. 18.

FIG. 19 shows an example of timing of precharging using the configuration shown in FIG. 18.

In the first and second precharge periods PC1 and PC2, the above-described two-stage precharge operation is performed by electrically connecting the data signal supply line DPLn with the first to third color component data lines Rn, Gn, and Bn by turning ON the first to third demultiplex switching elements DSW1 to DSW3 at the same time by the demultiplex control signals Rsel, Gsel, and Bsel.

In the drive period DR1 after the first precharge period PC1 and the drive period DR2 after the second precharge period PC2, the display panel 200 is driven based on the display data in which the write signals for each pixel are time-divided.

The above-described embodiment illustrates the case where the pixels are selected in units of three pixels corresponding to the R, G, and B color components. However, the present invention is not limited thereto. For example, the present invention can also be applied to the case where the pixels are selected in units of one, two, or four or more pixels.

Figure 17:
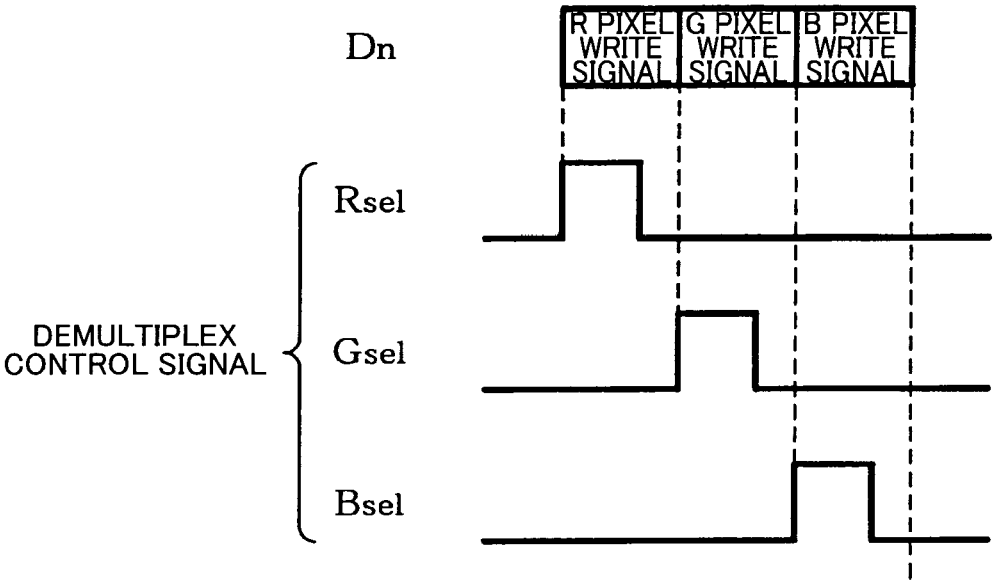
FIG. 17 is an explanatory diagram of a relationship between write signals, which are time-divided in units of color component pixels and correspond to display data for each color component, and demultiplex control signals.

In FIG. 17, the order in which the first to third demultiplex control signals (Rsel, Gsel, Bsel) go active is not limited to the order in the above-described embodiment.

The present invention is not limited to the above-described embodiment. Various modifications and variations are possible within the spirit and scope of the present invention.

Part of requirements of a claim of the present invention could be omitted from a dependent claim which depends on that claim. Moreover, part of requirements of any independent claim of the present invention could be made to depend on any other independent claim.

What is claimed is:

1. A display driver that drives a data line of a display panel, the display driver comprising:

a data line driver circuit that drives an output line connected with the data line based on a drive voltage corresponding to display data;

a first switching element connected between a first power supply line and the output line, a first power supply voltage being supplied to the first power supply line;

a second switching element connected between a second power supply line and the output line, a second power supply voltage is supplied to the second power supply line; and a switch control circuit that controls the first and second switching elements, the switch control circuit electrically connecting the output line with the first power supply line in a first period by setting the first switching element to an on-state and setting the second switching element to an off-state, electrically connecting the output line with the second power supply line in a second period after the first period by setting the first switching element to an off-state and setting the second switching element to an on-state, and setting the first and second switching elements to an off-state after the second period, the second period being provided immediately after the first period, or the second period being provided when a given period of time has elapsed after the first period, during the given period the first and second switching elements being set to an off-state, the data line driver circuit driving the output line in a third period after the second period, and the first period, the second period and the third period being in sequence within a horizontal scanning period.

2. The display driver as defined in claim 1, an absolute value of a difference between a voltage of the data line and the first power supply voltage being smaller than an absolute value of a difference between the voltage of the data line and the second power supply voltage, when the first period starts.

3. The display driver as defined in claim 2, the switch control circuit controlling the first and second switching elements so that the first period is longer than the second period.

4. The display driver as defined in claim 1, the first power supply voltage being higher than the second power supply voltage, a first precharge period being provided before a drive period in which a polarity of the drive voltage is negative with respect to a given reference potential, a second precharge period being provided before a drive period in which the polarity is positive with respect to the reference potential, and the switch control circuit:

setting the first switching element to an on-state and setting the second switching element to an off-state in a first divisional period in the first precharge period;

setting the first switching element to an off-state and setting the second switching element to an on-state in a second divisional period after the first divisional period;

setting the first switching element to an off-state and setting the second switching element to an on-state in a third divisional period in the second precharge period; and setting the first switching element to an on-state and setting the second switching element to an off-state in a fourth divisional period after the third divisional period.

5. The display driver as defined in claim 4, the switch control circuit controlling the first and second switching elements so that the first divisional period is longer than the second divisional period and the third divisional period is longer than the fourth divisional period.

6. The display driver as defined in claim 4, the switch control circuit including first to fourth divisional period setting registers, and controlling the first and second switching elements based on values set in the first to fourth divisional period setting registers.

7. The display driver as defined in claim 1, the first power supply voltage being a high-potential-side power supply voltage of the data line driver circuit, and the second power supply voltage being a low-potential-side power supply voltage of the data line driver circuit.

8. The display driver as defined in claim 1, the first power supply voltage being a maximum value of the drive voltage, and the second power supply voltage being a minimum value of the drive voltage.

9. A display device comprising:

a display panel that includes a plurality of scan lines, the data line, and a plurality of switching elements, each of the plurality of switching elements being connected with one of the scan lines and the data line; and the display driver as defined in claim 1 that drives the data line.

10. A drive method for driving a data line of a display panel, the drive method comprising:

providing a first switching element and a second switching element, the first switching element being connected between a first power supply line and the data line, a first power supply voltage being supplied to the first power supply line, the second switching element being connected between a second power supply line and the data line, a second power supply voltage being supplied to the second power supply line;

electrically connecting the data line with the first power supply line by setting the first switching element to an on-state and setting the second switching element to an off-state in a first period;

electrically connecting the data line with the second power supply line by setting the first switching element to an off-state and setting the second switching element to an on-state in a second period, the second period being provided immediately after the first period, or the second period being provided when a given period of time has elapsed after the first period, during the given period the first and second switching elements being set to an off-state; and setting the first and second switching elements to an off-state after electrically connecting the data line with the second power supply line, and driving the data line based on a drive voltage corresponding to display data in a third period after the second period, the first period, the second period and the third period being in sequence within a horizontal scanning period.

11. The drive method as defined in claim 10, the first power supply voltage being a high-potential-side power supply voltage of a data line driver circuit that drives the data line based on the drive voltage, and the second power supply voltage being a low-potential-side power supply voltage of the data line driver circuit.

12. The drive method as defined in claim 10, the first power supply voltage being a maximum value of the drive voltage, and the second power supply voltage being a minimum value of the drive voltage.

13. A drive method for driving a data line of a display panel, the drive method comprising:

providing a first switching element and a second switching element, the first switching element being connected between a first power supply line and the data line, a first power supply voltage being supplied to the first power supply line, the second switching element being connected between a second power supply line and the data line, a second power supply voltage being supplied to the second power supply line, the second power supply voltage being lower than the first power supply voltage;

in a first precharge period provided before a drive period in which a polarity of a drive voltage corresponding to display data being negative with respect to a given reference potential, setting the first switching element to an on-state, and setting the second switching element to an off-state in a first divisional period in the first precharge period, and setting the first switching element to an off-state and setting the second switching element to an on-state in a second divisional period after the first divisional period, the second divisional period being provided immediately after the first divisional period, or the second divisional period being provided when a given period of time has elapsed after the first divisional period, during the given period the first and second switching elements being set to an off-state; and setting the first and second switching elements to an off-state after the first precharge period, and driving the data line based on the drive voltage in the drive period, the first divisional period, the second divisional period and the drive period being in sequence within a horizontal scanning period.

14. The drive method as defined in claim 13, the first divisional period being longer than the second divisional period.

15. The drive method as defined in claim 13, the first power supply voltage being a high-potential-side power supply voltage of a data line driver circuit that drives the data line based on the drive voltage, and the second power supply voltage being a low-potential-side power supply voltage of the data line driver circuit.

16. The drive method as defined in claim 13, the first power supply voltage being a maximum value of the drive voltage, and the second power supply voltage being a minimum value of the drive voltage.

17. A drive method for driving a data line of a display panel, the drive method comprising:

providing a first switching element connected between a first power supply line and the data line, a first power supply voltage being supplied to the first power supply line, and a second switching element connected between a second power supply line and the data line, a second power supply voltage being supplied to the second power supply line, the second power supply voltage being lower than the first power supply voltage;

in a second precharge period provided before a drive period in which a polarity of a drive voltage corresponding to display data being positive with respect to a given reference potential, setting the first switching element to an off-state and setting the second switching element to an on-state in a third divisional period in the second precharge period, and setting the first switching element to an on-state and setting the second switching element to an off-state in a fourth divisional period after the third divisional period, the fourth divisional period being provided immediately after the third divisional period, or the fourth divisional period being provided when a given period of time has elapsed after the third divisional period, during the given period the first and second switching elements being set to an off-state; and setting the first and second switching elements to an off-state after the second precharge period, and driving the data line based on the drive voltage in the drive period, the third divisional period, the fourth divisional period and the drive period being in sequence within a horizontal scanning period.

18. The drive method as defined in claim 17, the third divisional period being longer than the fourth divisional period.

19. The drive method as defined in claim 17, the first power supply voltage being a high-potential-side power supply voltage of a data line driver circuit that drives the data line based on the drive voltage, and the second power supply voltage being a low-potential-side power supply voltage of the data line driver circuit.

20. The drive method as defined in claim 17, the first power supply voltage being a maximum value of the drive voltage, and the second power supply voltage being a minimum value of the drive voltage.

* * * * *